US007203566B2

(12) United States Patent
Terai et al.

(10) Patent No.: US 7,203,566 B2
(45) Date of Patent: Apr. 10, 2007

(54) KNIT DESIGN METHOD, APPARATUS THEREFOR AND PROGRAM THEREFOR

(75) Inventors: Koichi Terai, Wakayama (JP); Kenji Nishida, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/552,587

(22) PCT Filed: Mar. 24, 2004

(86) PCT No.: PCT/JP2004/004129

§ 371 (c)(1),
(2), (4) Date: Oct. 12, 2005

(87) PCT Pub. No.: WO2004/092468

PCT Pub. Date: Oct. 28, 2004

(65) Prior Publication Data

US 2006/0206231 A1 Sep. 14, 2006

(30) Foreign Application Priority Data

Apr. 15, 2003 (JP) ..... 2003-110224
Sep. 12, 2003 (JP) ..... 2003-321188

(51) Int. Cl.
*D04B 7/24* (2006.01)

(52) U.S. Cl. ..... 700/141; 66/232

(58) Field of Classification Search ..... 700/130, 700/141, 131, 132, 133; 66/232
See application file for complete search history.

(56) References Cited

U.S. PATENT DOCUMENTS 5,388,050 A * 2/1995 Inoue et al. ..... 700/131
5,557,527 A * 9/1996 Kotaki et al. ..... 700/131
5,719,777 A * 2/1998 Kotaki ..... 700/131
6,611,730 B1 * 8/2003 Stoll et al. ..... 700/131
6,698,253 B2 * 3/2004 Stoll et al. ..... 66/232
6,880,367 B2 * 4/2005 Suzuki ..... 66/232

FOREIGN PATENT DOCUMENTS

JP 5-78960 A 3/1993
JP 7-111021 B2 11/1995
JP 2631946 B2 7/1997
JP 2939908 B2 8/1999
JP 3325168 B2 9/2002

* cited by examiner

*Primary Examiner*—Danny Worrell
(74) *Attorney, Agent, or Firm*—Rothwell, Figg, Ernst & Manbeck

(57) ABSTRACT

A gore as a portion of a continuous elongated knitted fabric in a wale direction like a flared skirt is used. A knitted fabric formed by connecting a plurality of the gores in a course direction is designed. At the time of designing a pattern spread over a plurality of gores, the pattern is designed on the outer shape image as a composite image of the gores, and the design is divided into gores. At the time of assigning the pattern to the gores, it is checked whether any narrowing course is present in the pattern. If any narrowing course is present, on the upper side of the narrowing course, the left and right borders of the pattern are shifted toward the center of the knitted fabric, by the amount corresponding to the number of narrowing stitches from the center of the knitted fabric or the like.

14 Claims, 22 Drawing Sheets

Prior Art

KNIT DESIGN METHOD, APPARATUS THEREFOR AND PROGRAM THEREFOR

CROSS REFERENCE TO RELATED APPLICATION

This application is a 35 USC § 371 National Phase Entry Application from PCT/JP2004/0041 29, filed Mar. 24, 2004, and designating the U.S.

TECHNICAL FIELD

The present invention relates to a design of a knitted fabric for a flat knitting machine. In particular, the present invention relates to a technique for simplifying the design of a pattern spread over, e.g., a plurality of gores, or a body and a sleeve.

BACKGROUND ART

Japanese Patent No. 2631946 (U.S. Pat. No. 5,557,527) discloses a design of a knitted fabric knitted by a flat knitting machine. The design of the knitted fabric is performed on a computer. The outer shape of the knitted fabric is inputted as an image, and the types of knitting stitches or the like are inputted using color codes or the like. Usual, but complicated processes such as narrowing stitches, widening stitches, or cast off stitches are formed by storing a subroutine, and retrieving the subroutine from a library. The design data as created can be converted automatically into knitting data used in the flat knitting machine.

In some knitting fabrics such as a flared skirt (FIG. 14) or a sweater in a parachute pattern, the knitting width changes gradually. The design of such knitting fabrics is performed in units of gores (FIG. 15). The gore is an imaginary elongated knitted fabric continuous in the wale direction. The design is performed such that a plurality of the gores are connected in the course direction. The narrowing stitches (reduction in the number of stitches in the course by overlapping stitches) and the widening stitches are formed at borders between the gores. In a design image in FIG. 15, blocks in which the width decreases gradually from the lower side to the upper side by narrowing stitches are present. Further, on both sides of respective blocks, thin stripe-like blocks are present.

In the design using the gores, it is easy to design a pattern which falls within the area of one gore. However, at the time of designing a pattern which is spread over a plurality of gores, if any narrowing course or widening course passes through the pattern, the design becomes extremely difficult. An example of this case is shown in FIG. 1. In FIG. 1, reference numerals 4 to 8 denote blocks, and a reference numeral 10 denotes a central line of the knitted fabric. In the upper part and the lower part of FIG. 1, the knitted fabric is divided into gores. In the central part of FIG. 1, a composite image 2 formed by combining the blocks 4 to 8 is shown. Now, definition of the gore is explained. The blocks 4, 6, and 8 with narrowing stitches 12 and left and right rectangular blocks 5, 7 without narrowing stitches on both sides are combined to form one gore. For example, the blocks 4, 5 are the leftmost gore in the knitted fabric. Though divided blocks of the gore is illustrated (displayed) in the upper part in FIG. 1, in accordance with practice, display of the gore itself may also be possible. A reference numeral 14 denotes a narrowing course.

At the time of inputting a pattern 16, i.e., at the time of drawing, data may be inputted conveniently on the composite image 2 in the middle stage in FIG. 1. It is extremely difficult to imagine how the pattern 16 is assigned to the individual gores, and input the pattern 16 in units of gores separately. After inputting the pattern 16, problems may occur at the time of assigning the pattern 16 to the individual gores. If the composite image 2 is divided, and the pattern 16 is assigned to the individual gores in accordance with the input position of the composite image 2, the pattern 16 is deformed as shown in the lower stage in FIG. 1. The two stitches or the four stitches in the lower stage in FIG. 1 is the number of non-uniform stitches above and below the narrowing course 14. By the number of stitches, i.e., by the number of non-uniform narrowing stitches above and below the narrowing course 14, the pattern 16 appears to be shifted toward the outside of the knitted fabric. Explanation regarding FIG. 1 is not known.

SUMMARY OF THE INVENTION

Object of the Invention

An object of the present invention is to simplify the design spread over a plurality of gores, or the design spread over a sleeve and a body, and the design of a round pattern or the like.

Structure of the Invention

According to the present invention, a method of designing a knitted fabric by dividing a design of the knitted fabric into a plurality of parts is provided. The method comprises the steps of:

designing a pattern spread over a plurality of parts on a composite image of the plurality of parts such that the pattern is spread above and below a narrowing course or a widening course;

then, determining the number of non-uniform narrowing stitches or widening stitches above and below the narrowing course or the widening course;

shifting a portion of the pattern on the upper side of the narrowing course toward the center in the left-right direction of the knitted fabric relative to a portion on the lower side of the narrowing course by the amount corresponding to the stitch number of the narrowing stitches, or shifting a portion of the pattern on the upper side of the widening course toward the outer side in the left-right direction of the knitted fabric relative to the portion on the lower side of the widening course by the amount corresponding to the stitch number of the widening stitches, thereby assigning the pattern to the plurality of parts.

It is preferable that the plurality of parts comprise a plurality of gores, or a body and a sleeve.

A specific example of the shift will be given. For example, the non-uniform stitch number of the narrowing stitches or the widening stitches is determined for each of left and right borders of the pattern, and respective left and right borders of the pattern on the upper side of the narrowing course or the widening course are shifted relative to borders on the lower side by the amount corresponding to the determined non-uniform stitch number.

The order of the shift and assignment of the pattern will be described. For example, after the left and right borders of the pattern on the upper side is shifted relative to the borders on the lower side by the amount corresponding to the determined non-uniform stitch number, the pattern is assigned to the plurality of parts.

It is preferable that after the pattern is assigned to the plurality of parts imaginarily, portions of the respective parts of the pattern are shifted in the left-right direction by the amount corresponding to non-uniform narrowing stitches or widening stitches, and by the shift, data of the pattern assigned to imaginary wale without knitting stitches is deleted, or by the shift, if any wale which does not have assigned data of the pattern is generated, data of the pattern of the surrounding data is assigned.

It is preferable that an area which has already lost knitting stitches by the narrowing stitches at the height position of the lower end of the pattern is registered as a count prohibition area, an area which is going to lose knitting stitches by the narrowing stitches at the position higher than the lower end of the pattern is registered as a narrowing area, data of the pattern is assigned such that the count prohibition area is skipped, and the data of the pattern assigned to the narrowing area is skipped. In this manner, at the time of forming the narrowing stitches by gradually reducing the knitting width, it is possible to determine which data should be deleted, prevent deletion of the pattern concentrated in one part in the left-right direction, and distribute the deleted portion uniformly in the pattern.

In particular, it is preferable that the pattern of the entire knitted fabric is divided into a plurality layers, the layers are processed one by one, and relative movement between the layers is made possible. It is preferable that the knitted fabric is a cylindrical fabric without sewing as in the cases of the embodiments. However, the present invention can be applicable to any knitted fabric. For example, the knitted fabric may be only a front body. By using layers, it is possible to prevent that a vertically large pattern is deformed significantly due to the knitting stitches.

By the relative movement between the layers, and modification which is carried out for each of the layers, the design is not significantly affected by the narrowing stitches.

It is preferable that data of the pattern between a line extending from the height position of the lower end of the pattern and the end of the knitted fabric on a composite image of the plurality of parts is shifted into the knitting width as supplemental data. When the parts become gradually thin, and the knitting width of the knitted fabric is gradually reduced as a whole, the pattern is shifted toward the center of the knitting width. As a result, an area without any pattern is generated near the end of the knitted fabric. By shifting the supplemental data into the knitting width, the pattern near the end of the knitted fabric is supplemented.

Further, it is preferable that data outside the supplement data is warped around to the knitted fabric on the opposite side on the composite image of the plurality of images. Thus, the design which is spread beyond the end of the knitted fabric is made possible.

Further, it is preferable that the knitted fabric is a cylindrical knitted fabric, and based on a base position of the basic pattern as a unit of a round pattern, the stitch number for one round of the cylindrical knitted fabric near the base point, and the stitch number of the basic pattern, the layout of the basic pattern is determined. Thus, it is possible to design the round pattern for a flared skirt or a sweater in a parachute pattern.

Further, according to the present invention, a knit design apparatus comprising image input means, means for dividing a design image of a knitted fabric inputted by the image input means into a plurality of parts, means for converting the design image between a composite image formed by combining a plurality of parts and an image including a plurality of divided parts, and means for converting the obtained image data into knitting data used in a knitting machine is provided. The knit design apparatus further comprises:

means for detecting that a pattern of the knitted fabric inputted on the composite image is spread over the plurality of parts, and spread above and below a narrowing course or a widening course;

means for determining the number of non-uniform narrowing stitches or widening stitches above and below the narrowing course or the widening course; and means for shifting a portion of the pattern on the upper side of the narrowing course toward the center in the left-right direction of the knitted fabric relative to a portion on the lower side of the narrowing course by the amount corresponding to the stitch number of the narrowing stitches, or shifting a portion of the pattern on the upper side of the widening course toward the outer side in the left-right direction of the knitted fabric relative to the portion on the lower side of the widening course by the amount corresponding to the stitch number of the widening stitches, thereby assigning the pattern to the plurality of parts.

It is preferable that the plurality of parts comprise a plurality of gores, or a body and a sleeve.

Further, it is preferable that the knit design apparatus further comprises:

means for assigning the pattern to the plurality of parts imaginarily; and means for shifting the portion of the respective parts of the pattern in the left-right direction by the amount corresponding to non-uniform narrowing stitches or widening stitches, and by the shift, deleting data of the pattern assigned to imaginary wale without knitting stitches, or by the shift, if any wale which does not have assigned data of the pattern is generated, assigning data of the pattern of the surrounding data.

Further, according to the present invention, a knit design program comprising a command for dividing a design image of a knitted fabric into a plurality of parts, a command for converting the design image between a composite image formed by combining a plurality of parts and an image including a plurality of divided parts, and a command for converting the obtained image data into knitting data is provided. The knit design program further comprises:

a command for detecting that a pattern of the knitted fabric inputted on the composite image is spread over the plurality of parts, and spread above and below a narrowing course or a widening course;

a command for determining the number of non-uniform narrowing stitches or widening stitches above and below the narrowing course or the widening course; and a command for shifting a portion of the pattern on the upper side of the narrowing course toward the center in the left-right direction of the knitted fabric relative to a portion on the lower side of the narrowing course by the amount corresponding to the stitch number of the narrowing stitches, or shifting a portion of the pattern on the upper side of the widening course toward the outer side in the left-right direction of the knitted fabric relative to the portion on the lower side of the widening course by the amount corresponding to the stitch number of the widening stitches, thereby assigning the pattern to the plurality of parts. It should be appreciated that description regarding the knit design method or the knit design apparatus is also applicable to the knit design program.

In one embodiment, processes such as correction of the pattern is carried out from the lower side to the upper side of the knitted fabric. Alternatively, after inputting the pattern, the process may be carried out from the upper side to the lower side. In the case of narrowing stitches, if the process is carried out from the lower side to the upper side, at the upper portion of the narrowing stitches, for example, one wale is eliminated. On design, an imaginary wale is created by elimination of the narrowing stitches. In the case of widening stitches, if the process is carried out from the lower side to the upper side, an additional, e.g., one wale is created above the widening stitches. If the process is carried out from the uppers side to the lower side, the narrowing stitches appear like the widening stitches, and the widening stitches appear like the narrowing stitches. The shift is carried out by moving the portion above the narrowing course or the widening course relative to the portion below the narrowing course or the widening course. Alternatively, the portion above the narrowing course or the widening course is fixed, and the lower portion is shifted.

Advantages of the Invention

In the knit design method, apparatus, and program according to the present invention, a pattern spread over a plurality of parts is designed on a composite image of the parts. Therefore, the design of the pattern can be carried out easily. Further, at the time of dividing the composite image, the pattern can be suitably assigned to the respective parts. Thus, it is possible to overcome the constraint that the design of only the pattern which falls within an area of one gore can be made without any difficulty, in the case of designing a flared skirt or a sweater in a parachute pattern or the like. Further, it becomes easy to design the pattern spread over both of the body and the sleeve.

At the time of carrying out correction for the non-uniform narrowing stitches or widening stitches by the shift of the pattern, for example, one of the right and left borders on the upper side or the lower side is shifted by the amount corresponding to the stitch number of the non-uniform narrowing stitches or widening stitches. In particular, if the pattern is shrunk by the shift, the common portion of the shifted left and right borders should be determined as the area of the pattern. For example, the process should be carried out before dividing the composite design image into a plurality of parts.

Preferably, the shift is carried out after imaginarily assigning the pattern to a plurality of parts such that the portion of each part is shifted by the amount corresponding to the non-uniform narrowing stitches or widening stitches, and by the shift, data of the pattern assigned to the imaginary wale without knitting stitches is removed, or by the shift, when there is any wale without assignment of data of the pattern, the data of the pattern of the surrounding portion is assigned. Accordingly, it is possible shift the pattern relatively in the same manner as in the case of designing the image using the composite image.

If the count prohibition area and the narrowing area are used, it is easy to determine which data of the pattern should be deleted, and it is possible to prevent deletion of the pattern concentrated in one part in the left-right direction.

If a pattern which is spread largely in the height direction is designed, the upper part of the pattern is significantly deformed by correction for the narrowing stitches. Thus, the design in units of layers such as parts of the pattern is used. In the layer having the small width in the height direction, deformation in the pattern is small. Therefore, it is possible to reduce deformation of the pattern. Further, by the relative movement of the layers, it is ensured that the image of the entire pattern is maintained, and the important portion of the pattern is not deleted.

By the correction for the narrowing stitches, an area without any pattern at the end of the knitting width is generated. Therefore, the area is supplemented by a supplemental area. Further, the pattern of the surrounding warp-around area is assigned to the knitted fabric on the opposite side for making it possible to carry out the design extended over the knitted fabric beyond the end of the knitting width.

In the design of a round pattern or a front-back symmetrical pattern, for example, different upper and lower layers are used for processing the pattern in the two upper and lower rows to reduce deformation of the round pattern on the upper side, and make the relative movement between the round patterns possible. Further, the design of one pattern is the round pattern, and the other pattern is the front-back symmetrical pattern is made possible. By the supplemental operation and the warp-around operation, the process at the end of the knitting width becomes easy. The pattern moved by unslide correction is supplemented, and the pattern outside the supplemental area is warped around to the knitted fabric on the opposite side.

EMBODIMENTS

Hereinafter, embodiments and the most preferred embodiment for carrying out the present invention will be described.

Figure 1:
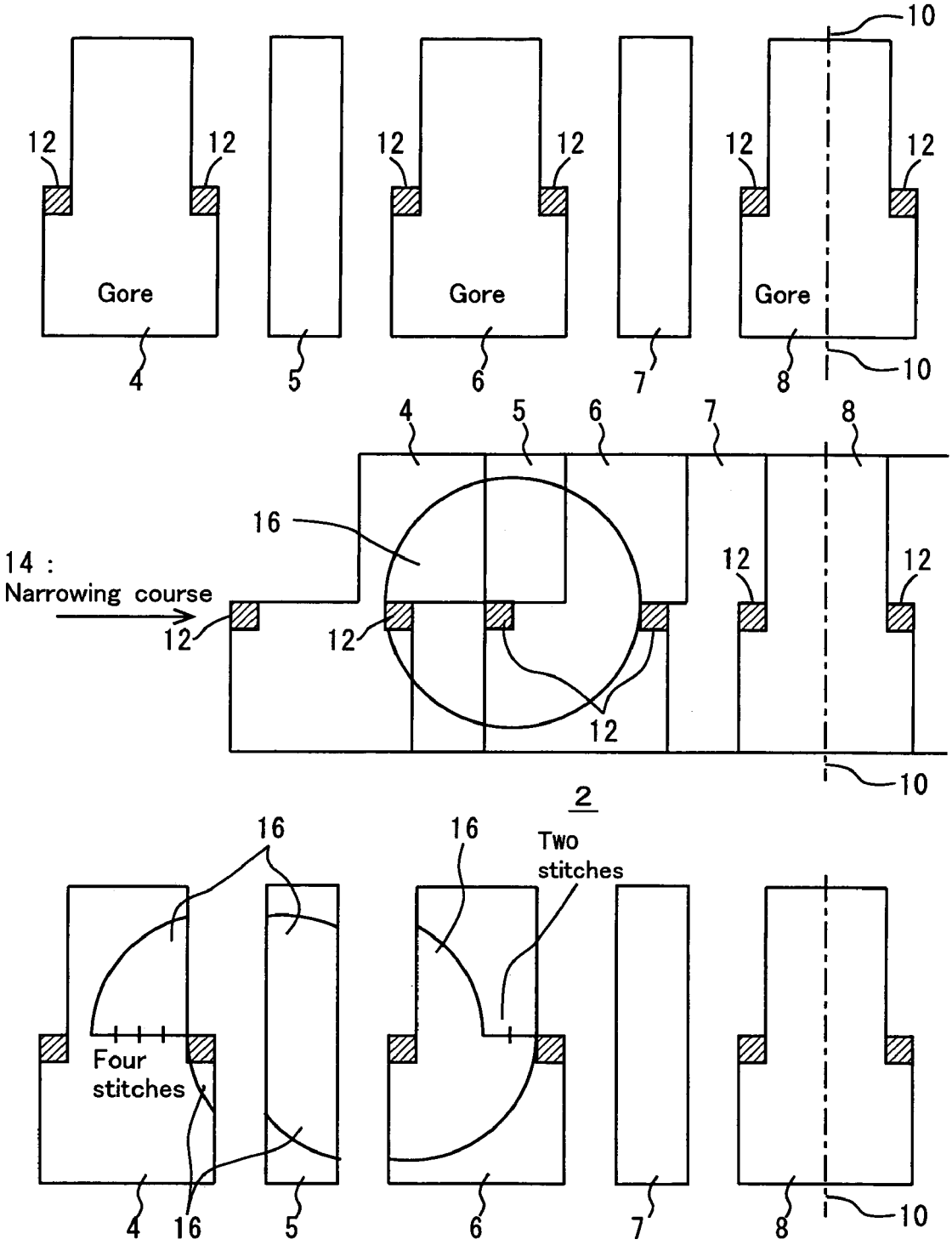
FIG. 1 is a view schematically showing a problem in a design using gores (conventional example).
Figure 2:
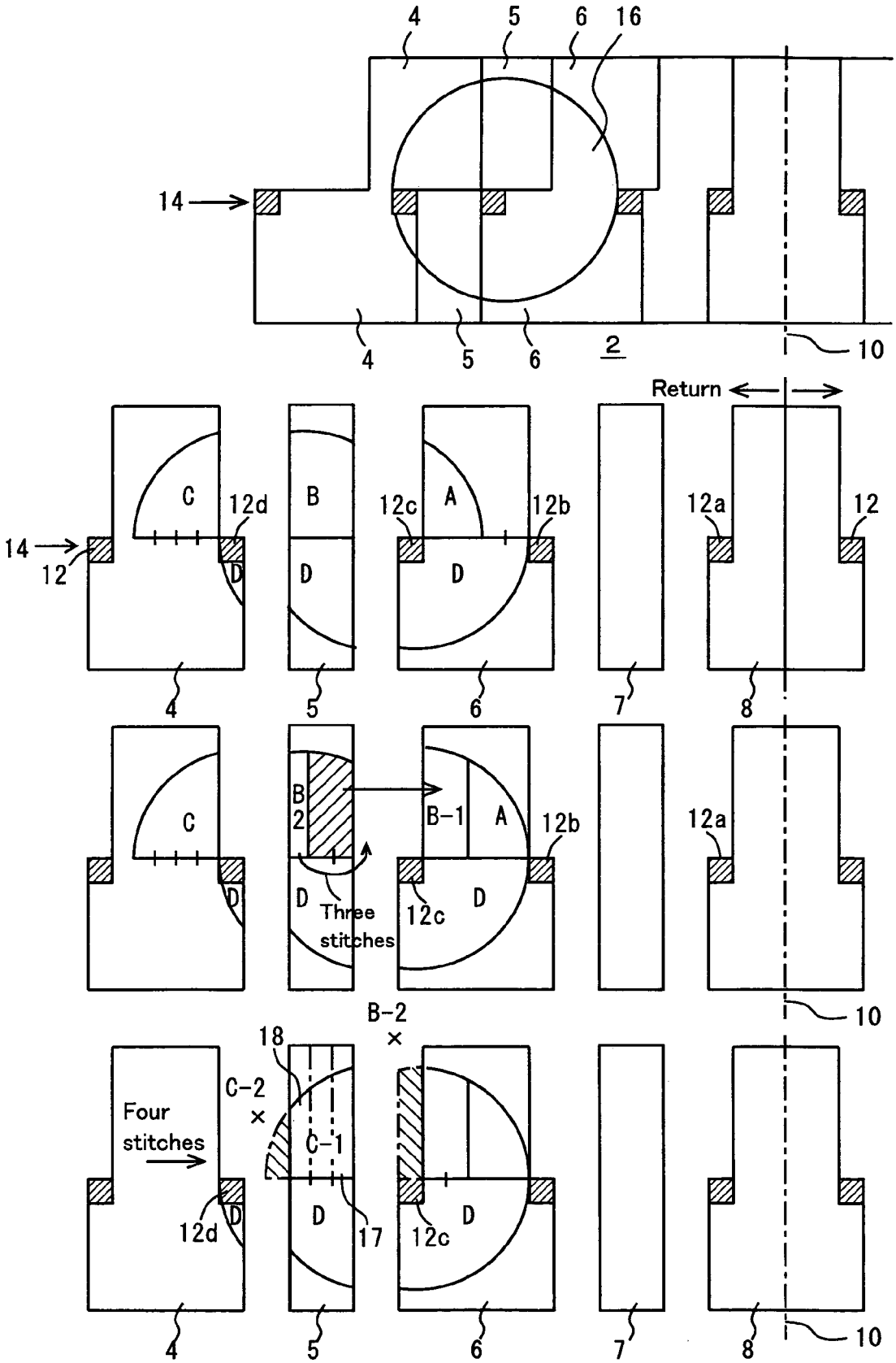
FIG. 2 is a view of a knit design method according to an embodiment in a design process of a flared skirt or the like using a plurality of gores, showing a method of assigning a pattern to the gores, in a case where the pattern used in the design is spread over the gores.

An embodiment and its modified embodiment (the first embodiment and the second embodiment) will be described with reference to FIGS. 2 to 13. The design of the knitted fabric will be described using the same reference numerals as used in FIG. 1. The reference numerals 2 to 16 are used commonly in FIG. 1 and in the embodiments. FIG. 2 shows the overview of a knit design method according to the first embodiment. In a composite image 2 of the knitted fabric, a pattern 16 such as Intersia or Jacquard, or a tissue is inputted. For example, the pattern 16 is positioned on the left side of a central line 10. Though not shown, as a preferred type of the knitted fabric, a cylindrical knitted fabric without sewing is used so as to obtain a three-dimensional silhouette easily. The pattern 16 is spread over three blocks 4, 5, and 6. A narrowing course 14 passes through the pattern 16. There are two narrowing stitches 12*a*, 12*b* on the right side of the pattern 16 as viewed from the central line 10. Further, there are two narrowing stitches 12*c*, 12*d* inside the pattern 16. Therefore, on the side above the course 14, the number of vertically non-uniform narrowing stitches, i.e., non-uniform narrowing stitches above, and below the course 14 is two in the block 6, the number of vertically non-uniform narrowing stitches is three in the block 5, and the number of vertically non-uniform narrowing stitches is four in the block 4.

As shown in the upper stage in FIG. 2, at the time of drawing the pattern 16 on the composite image 2, the composite image 2 is divided into individual blocks 4 to 8. Correspondingly, the pattern 16 is imaginarily assigned to the individual blocks 4 to 6. The word "imaginarily" is used because blocks A to C of the pattern 16 may be assigned to image data of the individual blocks 4 to 6 actually, and alternatively, the blocks A to C of the pattern 16 may be assigned to the data of the blocks 4 to 6 of the knitted fabric, and stored in a buffer or the like. Thus, at the time of the middle stage in FIG. 2, the assignment relationship between the pattern 16 and the blocks 4 to 6 has not been confirmed. Further, in accordance with the principle of the knit design, in the present embodiment, the knitting data is processed from the lower side to the upper side.

In the pattern 16, the portion of the block D below the narrowing course 14 is not affected by the narrowing course 14. Therefore, no correction (shift) is required. In contrast, in the block A, due to the narrowing stitches 12*a*, 12*b*, the number of the narrowing stitches is not uniform by two stitches vertically, therefore, the block A is shifted by two stitches toward the center of the knitted fabric (right side herein). The portion of the block B is affected by the three narrowing stitches 12*a*, 12*b*, 12*c*. The number of the narrowing stitches is not uniform by three stitches at the maximum. Therefore, the block B is shifted toward the center of the knitted fabric by three stitches.

The block B-1 comprising two wales on the right side of the block B can be positioned in an area generated in the block 6 by shifting the block A to the right. By shifting the portion of the block B-2 to the right by three stitches, the block B-2 is overlapped on the imaginary wale above the narrowing stitch 12*c*. In the specification, the imaginary wale means the wale eliminated by the narrowing stitch. Then, data of the block B-2 is deleted. The block C is affected by the narrowing stitches 12*a* to 12*d*. Therefore, the number of the narrowing stitches is not uniform by four stitches vertically. The block C is shifted to the right by four stitches. The block C-1 having the width of three wales can be placed in the block 5 of the knitted fabric where the block B was originally present. The block C-2 at the leftmost wale of the block C is overlapped on the imaginary wale on the narrowing stitch 12*d* by the shift of four stitches, and the data is deleted. As a result, the design of the lowermost stage in FIG. 2 can be obtained. The number of stitches for the shift should be substantially the same as the number of narrowing stitches or widening stitches which are not uniform vertically.

The shift of the blocks A to C has been described using the concept of the number of narrowing stitches which is not uniform above, and below the narrowing course 14. Though the shift of the block A can be explained easily using this concept, another explanation can be provided for the shift of blocks B and C. The block A is shifted to the right by two stitches corresponding to the narrowing stitches 12*a*, 12*b*, i.e., two wales. The resulting empty area is closed by shifting the block B to the right. Then, the data of the block B-2 shifted to the imaginary wale on the narrowing stitch 12*c* is deleted. The data of the block C is shifted to the right, to the wale where the Block B was originally present. Thus, the data of the block C-2 shifted to the imaginary wale is deleted.

In the explanation, each of the wales on the narrowing stitches 12*c*, 12*d* is regarded as the imaginary wale, and the data shifted to the imaginary wale is deleted. Interpretation of the imaginary wale is not limited in this respect. For example, in the lowermost stage in FIG. 2, a wale 17 may be regarded as the imaginary wale corresponding to the narrowing stitch 12*c*. In this case, the data of the leftmost wale of the block C-1 is deleted. Alternatively, a wale 18 may be regarded as the imaginary wale.

Figure 3:
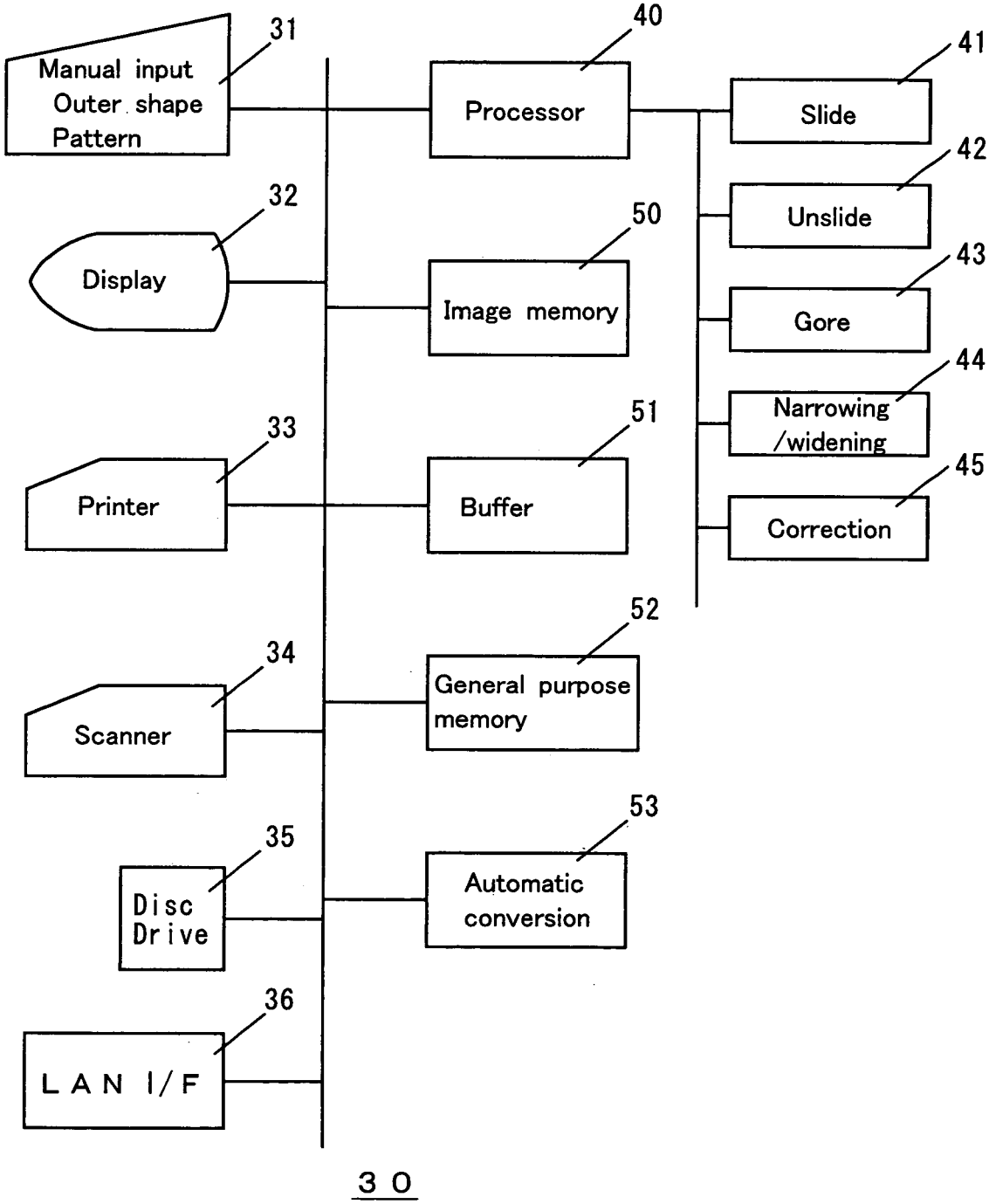
FIG. 3 is a block diagram of a knit design apparatus according to the embodiment.

FIG. 3 is a view showing structure of a knit design apparatus 30 according to the embodiment. A reference numeral 31 denotes a manual input device for inputting data such as the outer shape or the pattern of the knitted fabric. A reference numeral 32 denotes a display. For example, a design image of the knitted fabric or the like is displayed on a liquid display. A reference numeral 33 denotes a printer for outputting the design image of the knitted fabric or the like. A scanner 34 reads data such as the outer shape or the color of the knitted fabric or data such as Jacquard. A disc drive 35 drives a magneto-optical disc, a floppy disc, or a hard disc for the input/output of the design data of the knitted fabric or knit design programs. A LAN interface 36 is used for inputting/outputting design data of the knitted fabric, or inputting/outputting knitting data converted from the design data for a knitting machine such as a flat knitting machine.

A processor 40 carries out general processing such as the input/output of images. Further, the processor 40 carries out processing specific to the knitted fabric to be designed using gores, or the knitted fabric spread over both of the sleeve and the body. A slide processing unit 41 combines a plurality of gores or a plurality of blocks to create the composite image 2. An unslide processing unit 42 divides the composite image 2 into a plurality of gores or a plurality of blocks. A gore processing unit 43 divides the outer shape of the knitted fabric into gores or blocks at the time of designing the knitted fabric using gores such as a flared skirt or a sweater in a parachute pattern.

A narrowing/widening processing unit 44 inserts a narrowing course or a widening course for every predetermined number of courses, or at a position designated by the manual input device 31 or the like. The narrowing courses 14 shown in FIGS. 1 and 2 are examples of the narrowing course as inserted in this manner. In principle, the narrowing stitches 12, 12 are present on both sides of each gore, and no narrowing stitch is present in the blocks 5, 7 that are rectangular knitted fabrics. A correction unit 45 processes the pattern extending over a plurality of gores, and spread above, and below the narrowing stitch course or the widening stitch course such that the portion of the pattern is shifted toward the center of the knitted fabric, or both of the outer sides of the knitted fabric. An image memory 50 stores images of design data of clothes without sewing or the like. A buffer 51 stores temporal data. A general purpose memory 52 stores general purpose data. An automatic conversion processing unit 53 converts the design data of clothes without sewing or the like into the knitting data used in the flat knitting machine.

Figure 4:
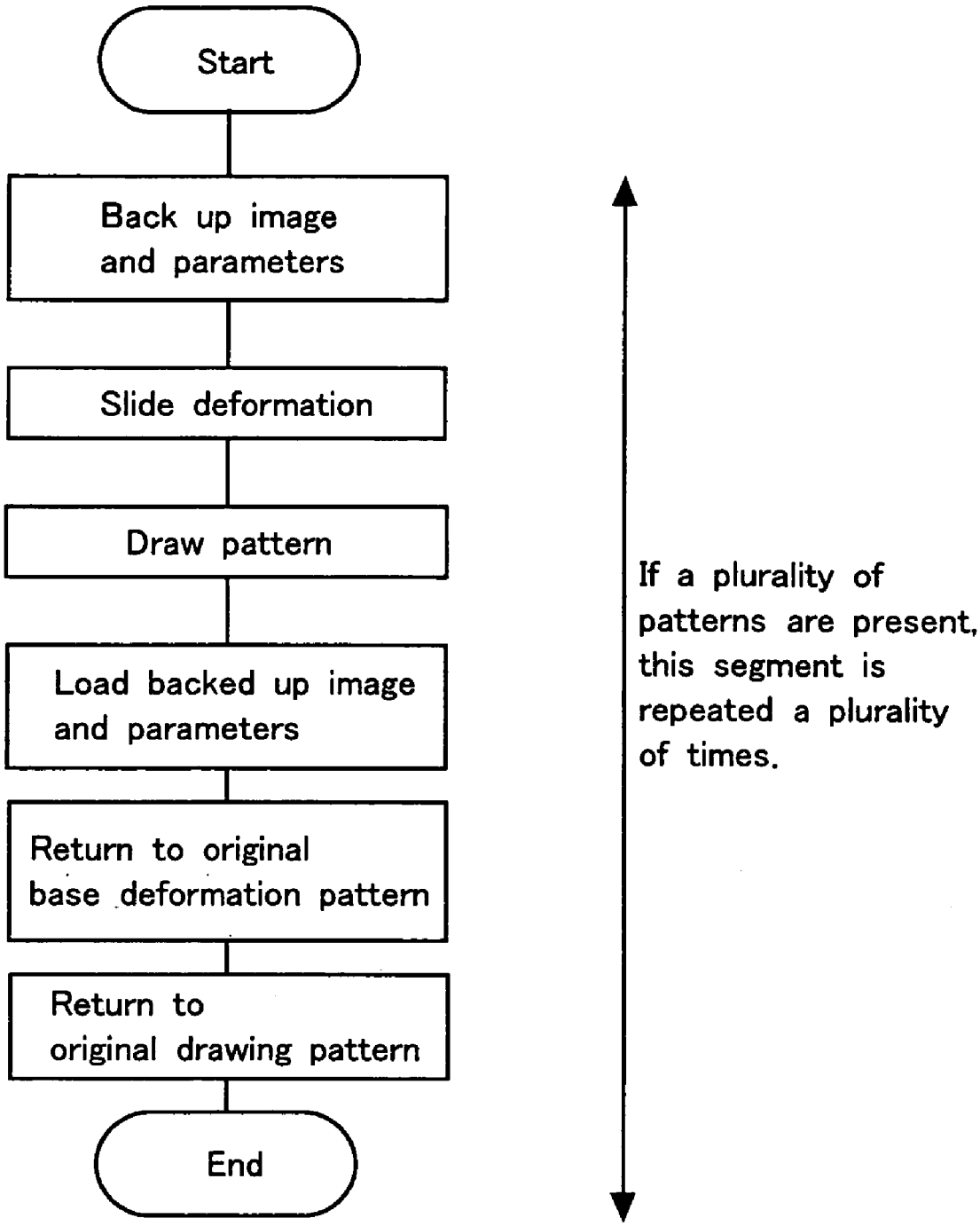
FIG. 4 is a flowchart showing a correction algorithm in a design using gores according to the embodiment.

FIGS. 4 to 7 show algorithms according to the embodiment. The algorithm in FIG. 4 shows the overview of the processes. For example, a pattern is present on the left side of the central line of the knitted fabric, and the pattern is processed. When the pattern is present on the right side of the central line, at the time of pattern correction, the pattern should be shifted to the left instead of the right. Further, initially, the design data is divided into a plurality of gores or a plurality of blocks.

The image divided into gores, blocks, or the like, and parameters are backed up. In the embodiment, the design data is designated using color codes. For example, the parameters include excluded colors of an area between blocks, where no knitting stitches are present. Images as divided blocks are slid to form a composite image. Then, a suitable pattern is drawn on the composite image, and the backed up image and the parameters are loaded. The composite image is divided back into the original blocks. The drawn pattern is assigned to the respective blocks. At this time, respective portions of the pattern are shifted in the left-right direction.

Figure 5:
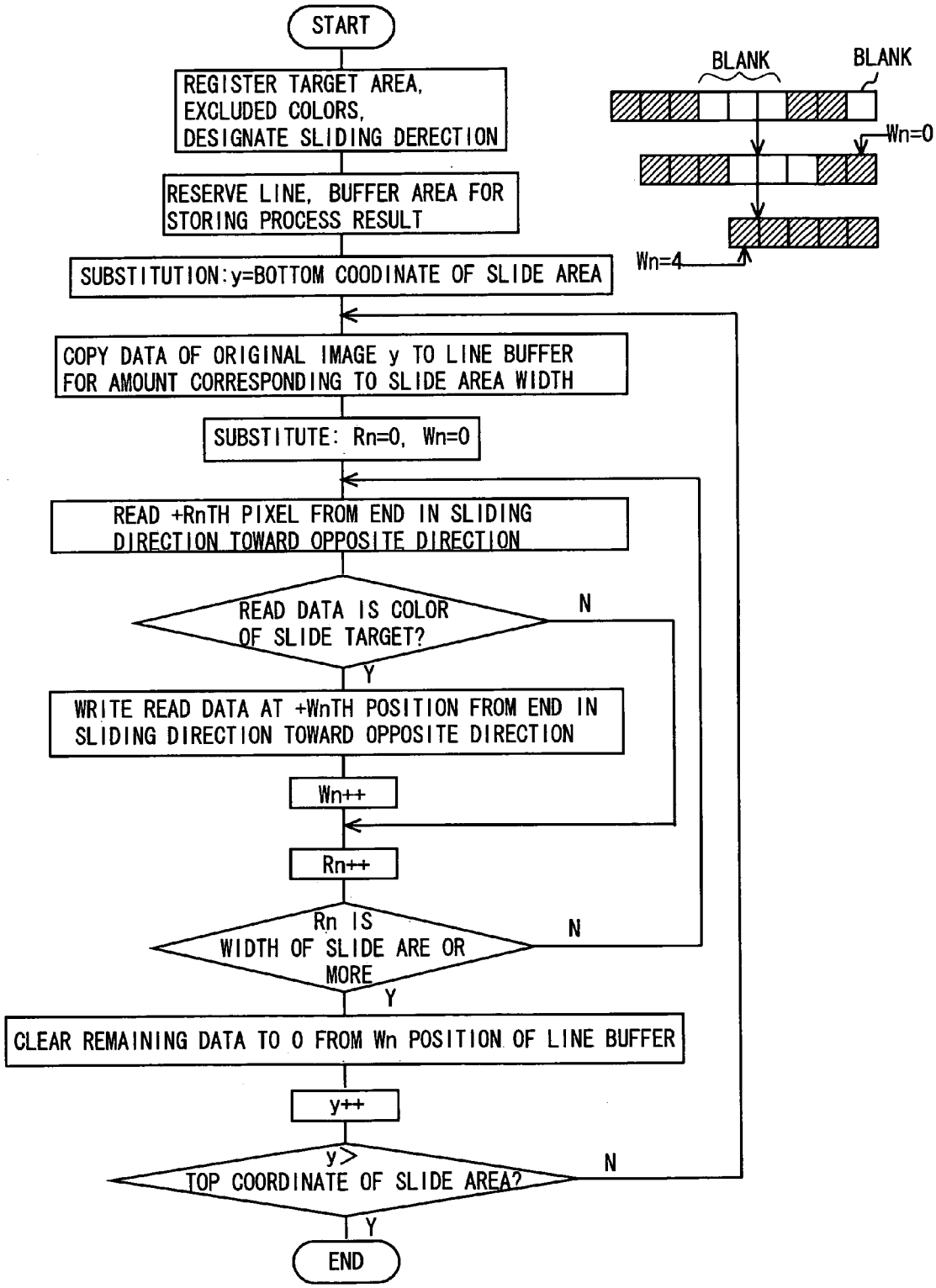
FIG. 5 is a flowchart showing an algorithm for sliding data to outer shape data as composite data of a plurality of gores.

In FIG. 5, the overview of the deformation process by the slide is shown. The slide target area and the sliding direction are designated. Further, excluded colors representing areas without knitting stitches are registered. As the knitting data, the area of the excluded color is, e.g., an area of a gap between blocks. Further, the line buffer area for storing the process result is reserved. The bottom coordinates of the slide area, i.e., the vertical direction in the slide area is determined as the y direction, and the left-right direction in the slide area is determined as the x direction. The y coordinate at the bottom of the slide area is substituted for the variable y.

The data where the y coordinate of the original image before the slide is y is copied to the line buffer by the amount corresponding to the slide area. Then, the initial value of the number Rn of the pixel read from the buffer is determined as 0, and the initial value of the number Wn of the pixel written into the line buffer is determined as 0. The data of the Rnth pixel from the end in the shifting direction by the slide toward the opposite direction is read, and it is checked whether the read pixel represents the color of the slide target, i.e., whether the read pixel represents the excluded color or not. If the read pixel represents the color of the slide target, the read data is written to the Wnth pixel from the end in the sliding direction toward the opposite direction in the line buffer. If the writing operation has been performed, the variable Wn is incremented by 1. Then, the variable Rn is incremented by 1. The process is repeated until the value of Rn reaches the width of the slide area or more. After the process for the slide area is finished, the remaining data from the position Wn of the line buffer (left side in FIG. 5) is cleared to 0, and the y coordinate is incremented by 1. The above loop is repeated until the y coordinate reaches the top coordinate (the value of y is the maximum) of the slide area, and slide deformation is finished.

An example of sliding two blocks by one course is shown schematically in the uppermost row on the right side in FIG. 5. The first block has the block size of two stitches. On the design data, for example, the first block has the width of two pixels, and there is an area of excluded colors comprising three pixels between the first block and the second block. The second block has the width of three pixels. Firstly, the rightmost pixel of the excluded color is eliminated, and the first pixel in the first block is copied to the rightmost position in the line buffer. The number of the copied pixels, i.e., the value of Wn is incremented to 1. In this manner, after the first block and the second block are processed, the gap between the first block and the second block is eliminated, and the final value of the variable Wn becomes 5. The original block position or the number of pixels of the excluded colors between blocks have already been backed up.

Figure 6:
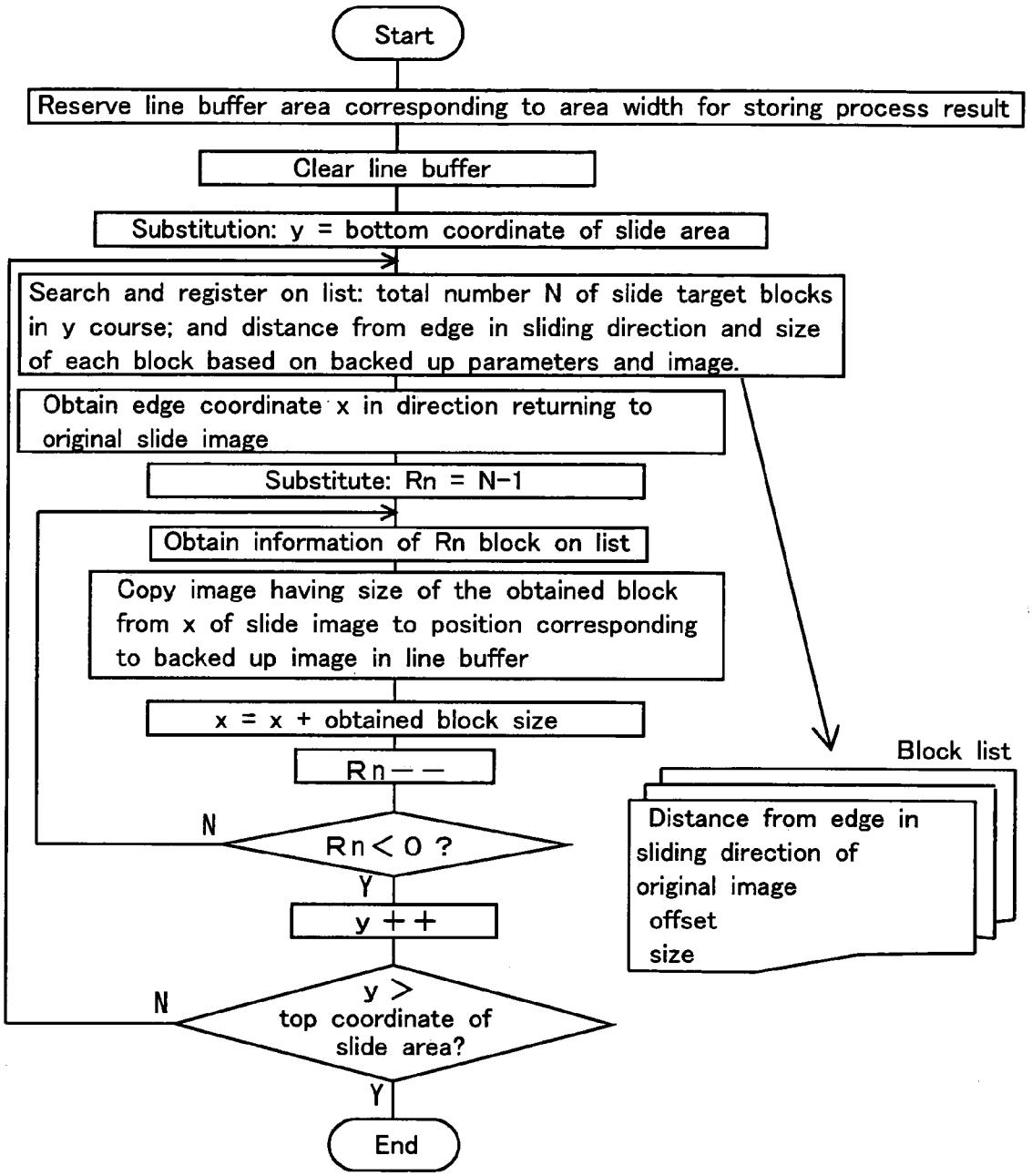
FIG. 6 is a flowchart showing an algorithm for returning the outer shape data as composite data to the gores by releasing the slide.

FIG. 6 shows the process of dividing the composite image into images of individual blocks. An area of the line buffer corresponding to the area width needed for storing the process result is reserved, and the line buffer is cleared. The bottom coordinate of the slide area in the y direction is substituted for the value of y.

For each of the courses, based on the backed up parameters and the image, the total number N of the blocks of the slide target, the distance from the edge in the sliding direction and the size for each block are searched, and registered in a block list shown on the right side in FIG. 6. The coordinate x of the edge in the direction of returning the slide image to the original image is obtained. Then, the value of the variable Rn is set to N−1, and the size of the block is obtained. An image corresponding to the size from the edge to this block is copied from the composite image to the line buffer. An area corresponding to the block width starting from the edge coordinate x is determined as the copy position.

The value of the processed block size is added to the value of the edge coordinate x, and the variable Rn is decremented by 1. If the value of Rn is not negative, information of the next block is obtained. After continuing these processes, when all the blocks are processed, the y coordinate is incremented by 1. The processes are repeated until the top coordinate is reached. Each time the process for one line is finished, the image of the line buffer is written in the image memory. Therefore, the knitting data with the input of the pattern on the composite image is divided into the individual blocks, and rewritten in the image memory.

Figure 7:
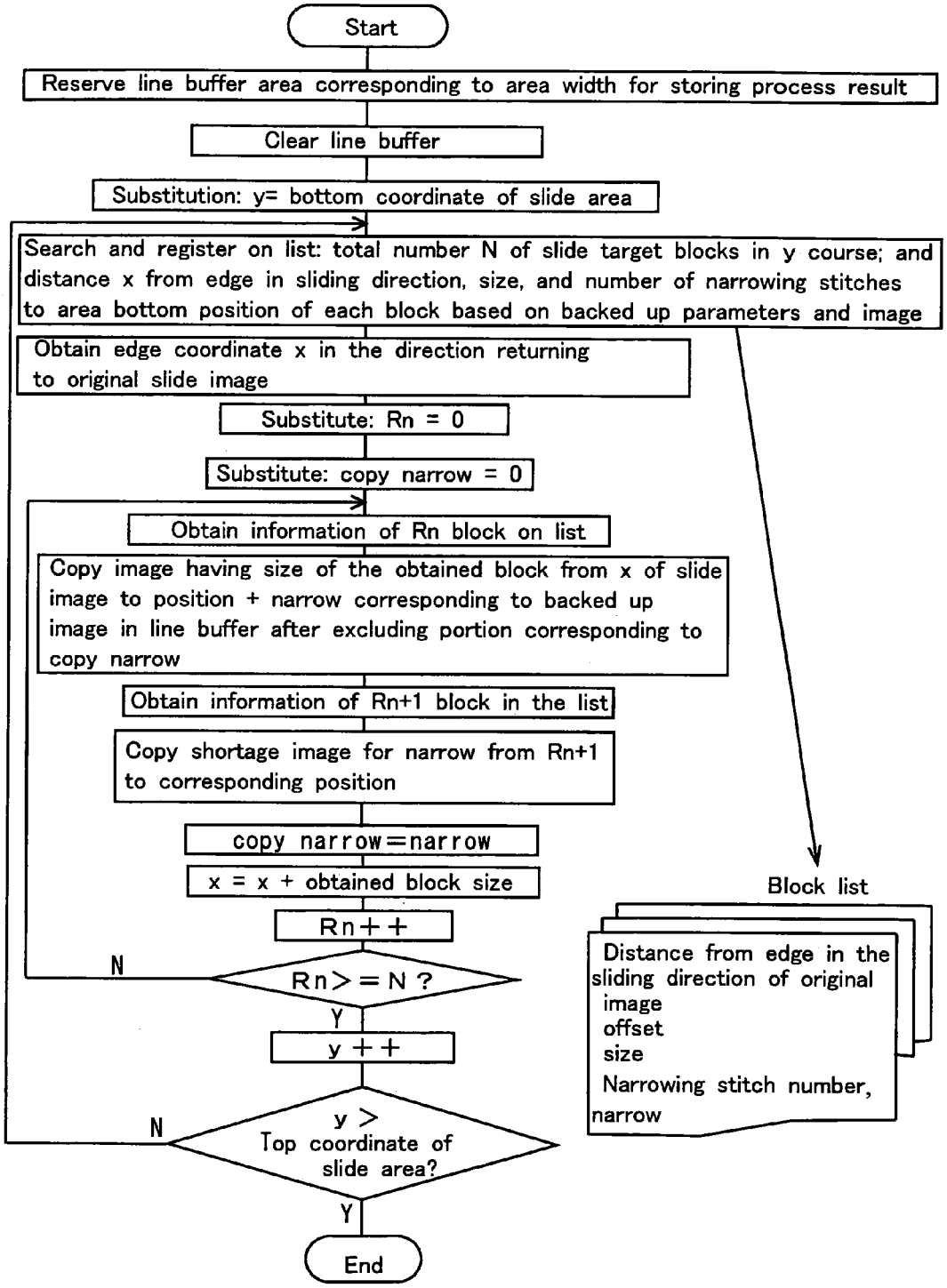
FIG. 7 is a flowchart showing an algorithm for mapping the pattern to the gores according to the embodiment.

FIG. 7 shows the process after the process in FIG. 6. In FIG. 7, blocks of the pattern are shifted. An area of the line buffer corresponding to the area width for storing the process result is reserved. The width may be the width from the center to the left end or the right end in the knitted fabric or the maximum width of one pattern. The reserved line buffer area is cleared. The bottom coordinate of the pattern is substituted for y.

For each course, using the backed up parameters and the backed up image, the total number N of the blocks of the slide target is determined. Further, the distance from the edge in the sliding direction and the size for each block are determined. In the case of FIG. 2, for example, the number of narrowing stitches for the block A is two, and the number of the narrowing stitches for the block C is four above the narrowing course 14. By these numbers, the shift length is determined. The edge coordinate x is obtained, the initial value of the variable Rn is set to 0, and the initial value of the variable 'copy narrow' is set to 0.

Data for one block is obtained. After excluding the portion for 'copy narrow' from the image having the size of the obtained block, the resulting image is copied to the position '+narrow' corresponding to the backed up image in the line buffer, and shifted by the coordinate 'narrow' toward the center of the knitted fabric. In the case of block A in FIG. 2, the value of 'narrow' is 2. Data of the next block, in the case of FIG. 2, for example, the block B is read, and the image for the shortage of two stitches is copied to the position of the area created by the shift of the block A. Then, the value of 'narrow' is inputted to the variable 'copy narrow', and the value of the variable x is increased by the value corresponding to the obtained block size. The variable Rn is incremented by 1, and the routine proceeds to the process for the next block. The data of the next block is obtained. For example, in the case of the block B in FIG. 2, in the process for the block A, since the data has been shifted by two stitches toward the block A, the portion is excluded as the 'copy narrow' portion, and the data for the remaining one stitch is obtained. By copying the data for one stitch to the coordinate of the position '+narrow' corresponding to the backed up image, the value of 'narrow' becomes three stitches in the block B, which is the imaginary wale above the narrowing stitch 12*c*. Therefore, the data of the block B-2 is cleared. Then, the value 3 of 'narrow' is substituted for the new value of 'copy narrow', and the edge coordinate x is changed. Then, the next block is processed. After these processes are carried out until the top coordinate of the slide area is processed, the process of the pattern is finished.

FIGS. 8 to 12 shows the second embodiment. In comparison with the second embodiment, in the first embodiment, the pattern after correction of the narrowing stitches is similar to the pattern inputted visually using the composite image.

Figure 8:
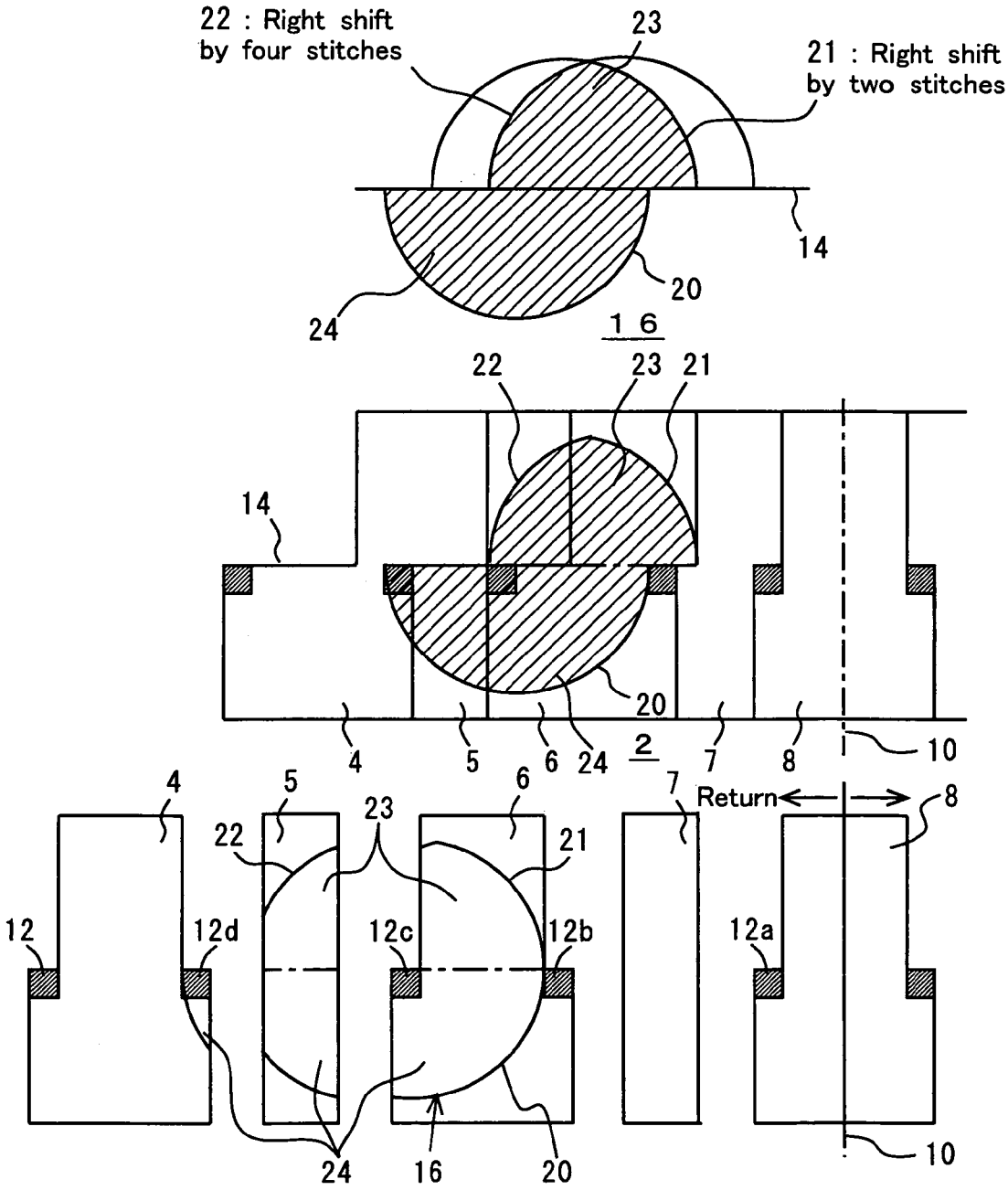
FIG. 8 is a view showing assignment of a pattern to gores in a knit design method according to a second embodiment.

The overview of processes in the second embodiment is shown in FIG. 8. In FIG. 8, the constituent elements that are identical to those shown in FIGS. 1 and 2 are labeled with the same reference numeral. As in the cases of FIGS. 1 and 2, it is assumed that a pattern 16 has been inputted. A reference numeral 20 denotes a borderline of the portion of the pattern 16 below the narrowing course 14. A reference numeral 21 denotes a borderline of the portion of the pattern 16 above the course 14, and the borderline 21 has been shifted to the right by two stitches in consideration of the two narrowing stitches 12*a*, 12*b*. A reference numeral 22 denotes a borderline of the portion of the pattern 16 above the course 14, and the borderline 22 has been shifted to the right by four stitches in consideration of the narrowing stitches 12*a* to 12*d*. A block 23 is a common portion defined by the borderlines 21, 22. A block 24 is a portion below the course 14.

Before dividing the composite image into the respective blocks, the pattern 16 is corrected. The result is shown at the middle stage in FIG. 8. The block 24 is not changed. The left and right borderlines of the block 23 are the borderlines 21, 22. Then, after releasing the slide, an image at the lower stage in FIG. 8 can be obtained. The distortion of the design at the uppermost portion of the block 23 is not preferable in comparison with the first embodiment.

Figure 9:
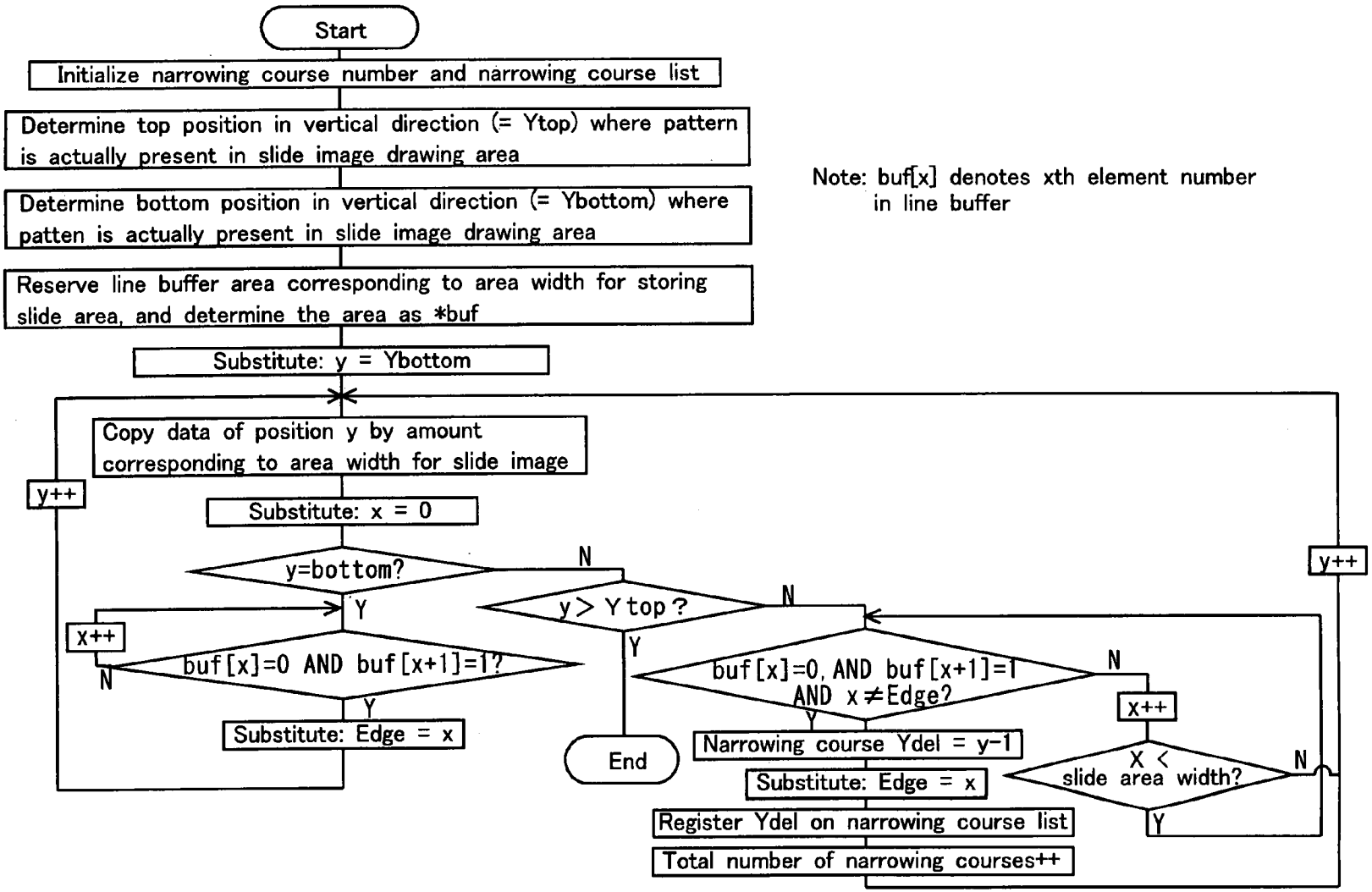
FIG. 9 is a flowchart showing an algorithm for determining the position of a narrowing course and the number of narrowing stitches.

In the same manner as in the case of the first embodiment, combination of the divided images of blocks (slide) into the composite image and division of the composite image into the blocks (unslide) are carried out. In FIG. 9, the process of determining the number of narrowing courses and y coordinates of the narrowing courses is shown. The variable representing the total number of the narrowing courses and the list of the narrowing courses are prepared, and the variable and the list are initialized. Then, the top coordinate and the bottom coordinate in the y direction in the range where the pattern is present are determined, and the line buffer area corresponding to the width of the slide area is reserved. Then, the process is repeated for each of the y coordinates from the bottom coordinate to the top coordinate by shifting one course upwardly each time the process is carried out. Since the edge position of the block is different between the bottom coordinate and the top coordinate, the narrowing course is detected, and the y coordinate of the narrowing course is registered in the course list. The number of the narrowing courses is incremented by 1. The total number of narrowing stitches in one narrowing course is equal to the value calculated by multiplying the number of gores by 2. Therefore, if the gore is determined, it is possible to determine how many narrowing stitches have been processed after the center of the knitted fabric.

Figure 10:
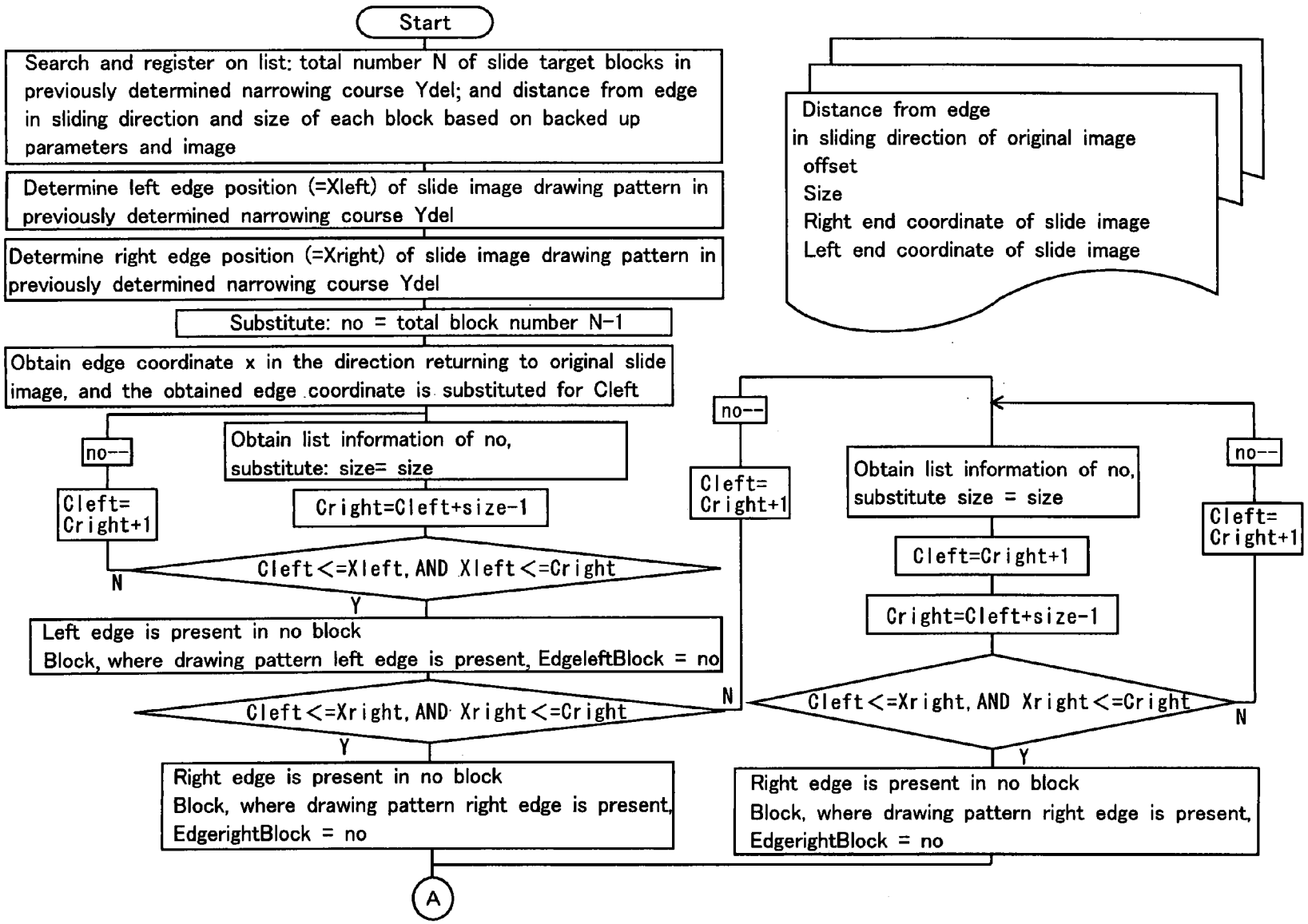
FIG. 10 is a flowchart showing an algorithm for determining left and right edges of a pattern according to the second embodiment.

FIG. 10 shows the process of determining the left and right edges of the pattern. The output of the process is the number of the block where the edge is present. The total number N of the blocks as the slide targets of the narrowing course Ydel, the distance from the edge in the sliding direction of each block, and the block size are searched, and registered in the list. Further, the positions of the left and right edges of the pattern in the narrowing course Ydel are determined. Next, from the first block, the coordinates of both ends of the block are determined. If the left edge of the pattern is positioned between both ends of the block, it is determined that the left edge is present in the block, and the block number where the left edge is present is stored. If the right edge of the pattern is positioned between both ends of the block, it is determined that the right edge is present in the block, and the block number where the right edge is present is stored. In this manner, from the edge in the sliding direction, i.e., from the center of the knitted fabric, the process of the block is shifted one by one to the next block toward the edge on the end side of the knitted fabric, and the block numbers where the left and right edges of the pattern are present are determined.

Figure 11:
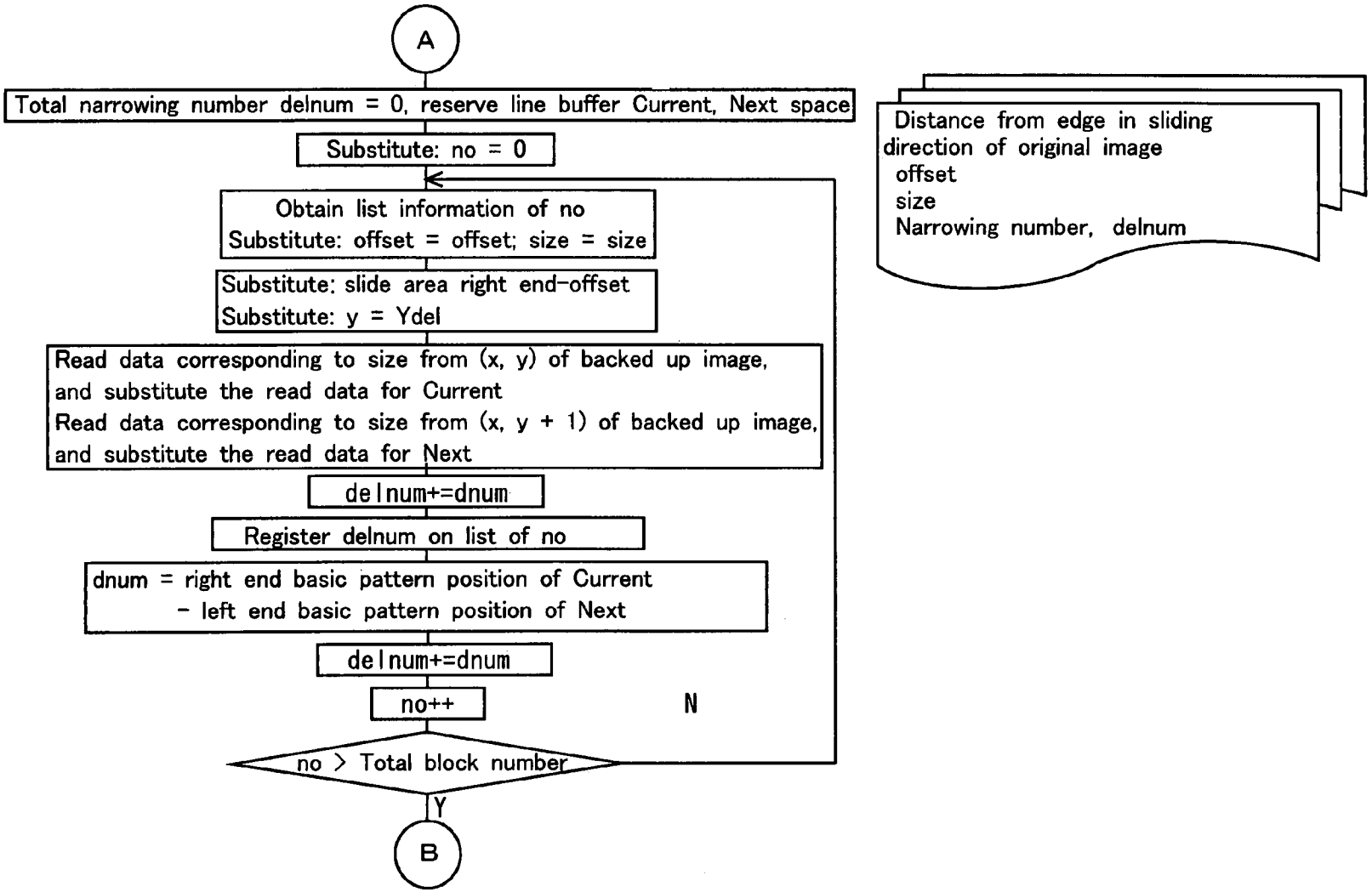
FIG. 11 is a flowchart showing an algorithm for determining the shift number for each block of the pattern.

The routine proceeds from the connector A in FIG. 10 to the process in FIG. 11 for determining the shift number for each of the blocks of the pattern. In consideration of the narrowing course, the difference between the narrowing course and the course which is one course above the narrowing course is determined as the variable dnum, and the value which is obtained by adding the value dnum from the block at the edge in the sliding direction is determined as the variable delnum. The variable delnum is stored for each of the blocks. The value delnum is determined for every block.

Figure 12:
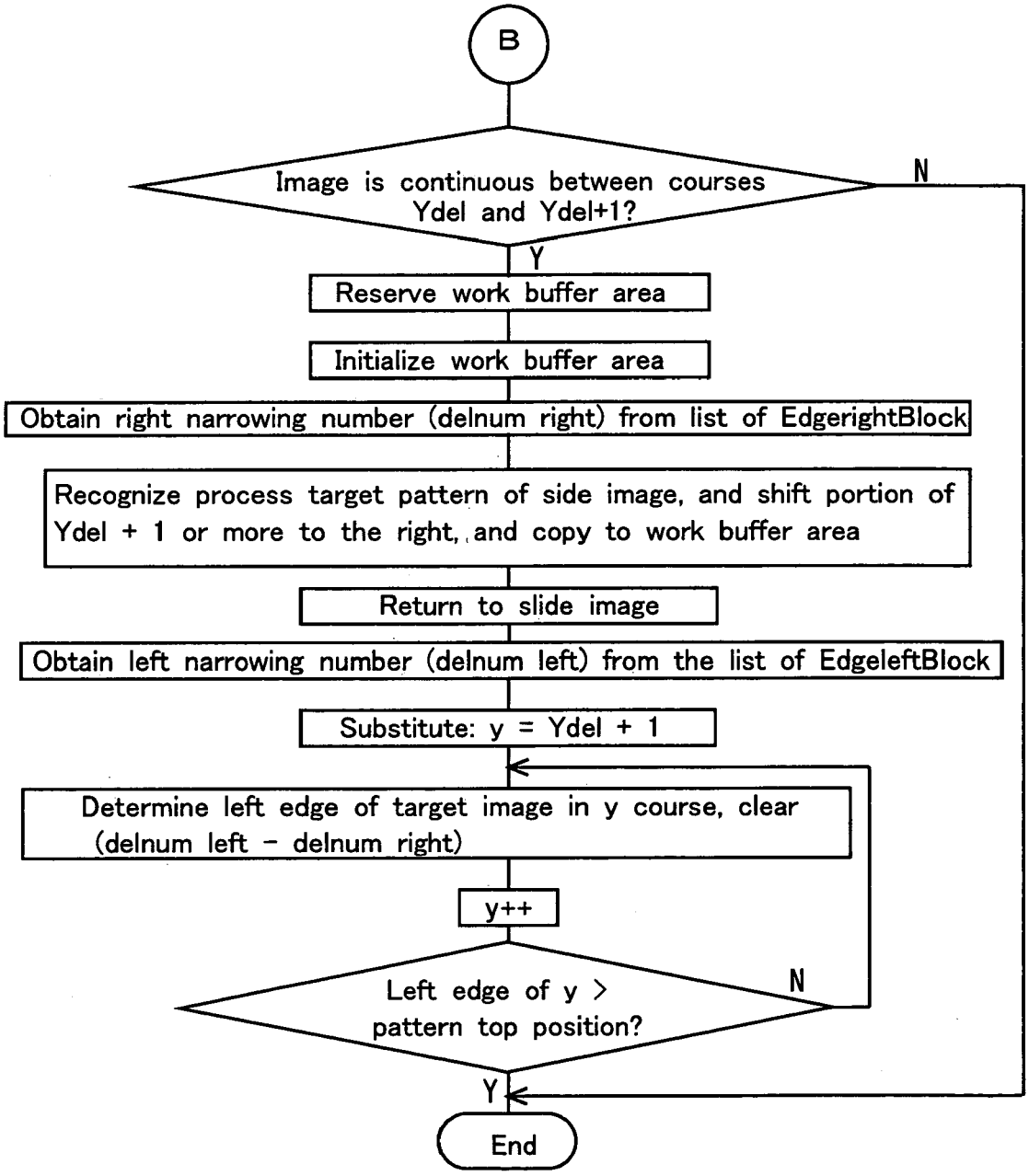
FIG. 12 is a flowchart showing a correction algorithm of a pattern according to the second embodiment.

The routine proceeds from the connector B in FIG. 11 to the process in FIG. 12. It is checked whether the pattern is continuous between the narrowing course and the course which is one course above the narrowing course. When the pattern is continuous, i.e., if there is any pattern which is continuous over the courses on both of upper and lower sides of the narrowing course, a work buffer area is reserved, and initialized. The variable delnum is obtained from the list of the edge right block as the right narrowing number delnum right. The process target pattern in the slide image is recognized. In the courses above the narrowing course Ydel (the courses of Y del+1 or more), an image of the process target pattern is shifted to the right by the amount corresponding to the right narrowing number, and copied to the work buffer area. Next, for example, the image of the process target pattern in the work buffer area is returned to the slide image. In this manner, the process target pattern in the slide image is shifted to the right by the amount corresponding to the right narrowing number in the courses above the narrowing course. Then, the left narrowing number is obtained from the list of the edge left block, and determined as the variable delnum left. The course number Ydel+1 of the course above the narrowing course is substituted for the variable y. Thereafter, for the respective courses above the narrowing course, an area of the shifted image near the left edge corresponding to the difference between the left narrowing number and the right narrowing number is cleared until the y coordinate of the left edge of the pattern gets larger than the y coordinate of the top coordinate of the pattern. When a plurality of narrowing courses are present in one pattern, each time the process for a new narrowing course is performed, the routine should return to the first step in FIG. 12.

Referring back to FIG. 8, the above process is carried out by shifting the right edge of the image representing the pattern by two stitches corresponding to the right narrowing number for shifting the image (pattern) to the right by two stitches, above the narrowing course 14, and clearing an area of the shifted image near the left edge above the narrowing course by two stitches corresponding to the difference between the left narrowing number and the right narrowing number (the number of narrowing stitches in the pattern). The target of the shifting process or the clearing process is the image above the narrowing course. For simplicity, in this paragraph, explanation that the target is above the narrowing course may be omitted. As the process similar to the above-described process, the left side edge of the image may be shifted to the right by the amount corresponding to the left narrowing number for shifting the image to the right, above the narrowing course, and then, the area of the shifted image near the right edge may be cleared by the amount corresponding to the difference between the left narrowing number and the right narrowing number. Alternatively, in the courses above the narrowing course, the image is shifted to the right by the amount corresponding to the left narrowing number of the left side edge, the image is shifted to the right by the amount corresponding to the right narrowing number of the right side edge, and the AND image of these images is used.

The above-described three processes will produce the same result when the pattern is in one color, and will produce different results when there is a design in the pattern, depending on which part of the pattern is deleted. In the courses above the narrowing course, in the first process, the design near the left side edge in the pattern is deleted, in the second process, the design near the right side edge is deleted, and in the third process, for example, the design near the center in the pattern is deleted. Therefore, it is preferable that the above three processes should be selectively carried out by a user.

Figure 13:
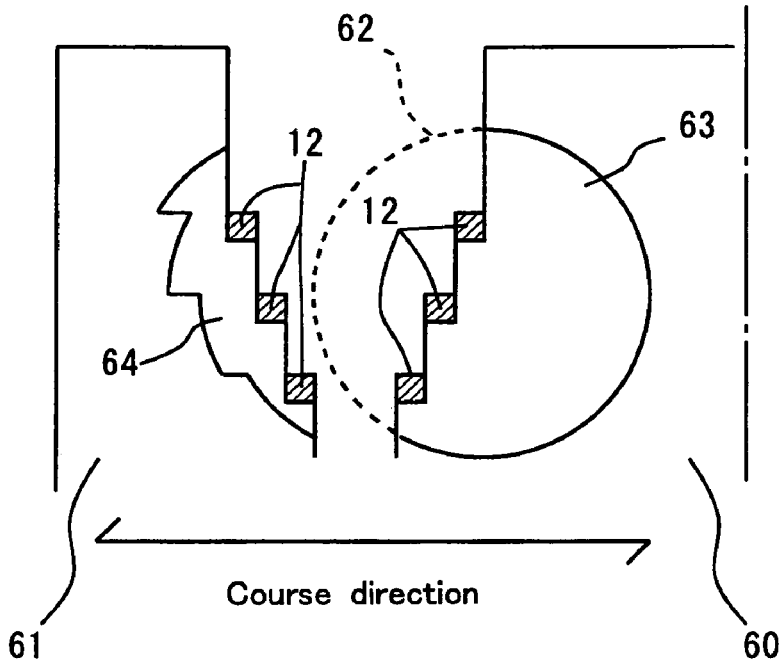
FIG. 13 is a view schematically showing an example of applying the first embodiment to a pattern spread over the sleeve and the body.
Figure 14:
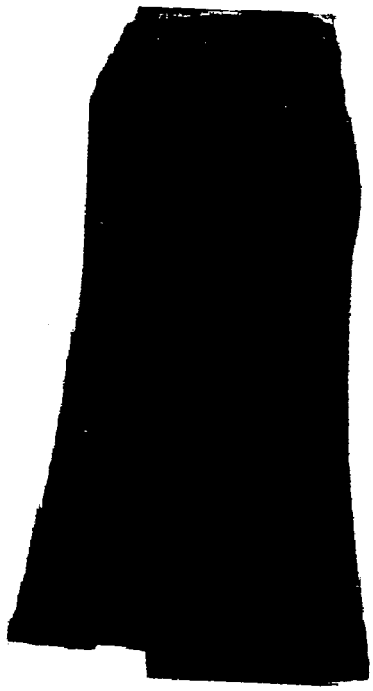
FIG. 14 is a view showing a flared skirt.
Figure 15:
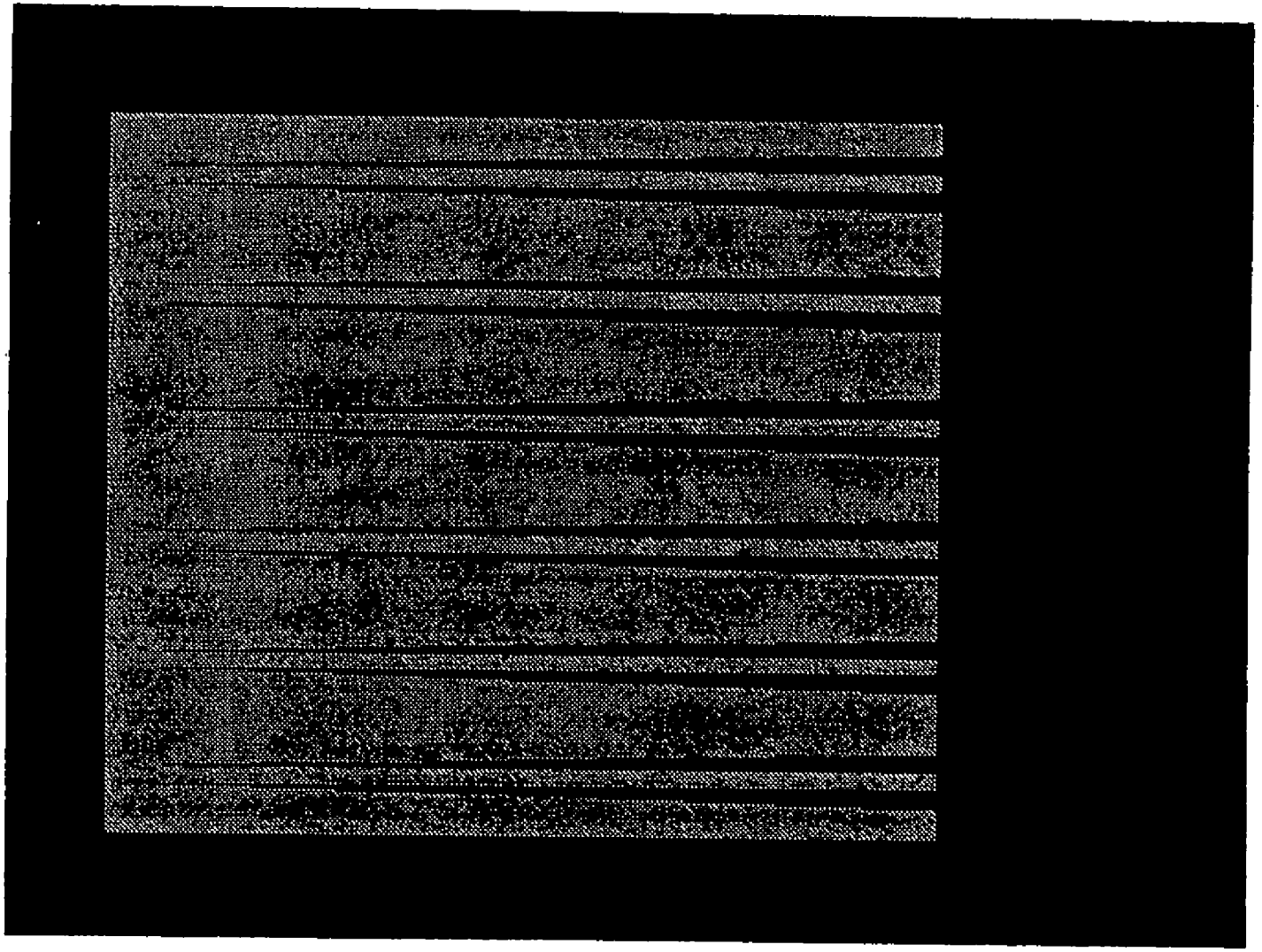
FIG. 15 is a view showing a design image using gores of the flared skirt in FIG. 14.

The embodiments are also applicable to the design of a pattern extending over both of the sleeve and the body. Such an example is shown in FIG. 13. A reference numeral 60 denotes a body, and a reference numeral 61 denotes a sleeve. The course direction of the body 60 and the course direction of the sleeve 61 is the left-right direction in FIG. 13. A reference numeral 62 denotes a pattern inputted on a composite image. It is not necessary to correct a block 63 of the pattern 62 on the body 60. If the body 60 is regarded as a gore on the central side of the knitted fabric, and the sleeve 61 is regarded as a gore on the outside of the knitted fabric, the process as in the cases of the first and second embodiments can be performed. The pattern on the sleeve 61 is corrected like a block 64.

Though the embodiments have been described in connection with the narrowing course. The present invention is similarly applicable to the widening course. In this case, the blocks of the pattern above the widening course should be shifted to the outer side of the knitted fabric. As for the new wale above the widening course, data of left and right wales in the pattern or the like should be copied. Alternatively, the left border and the right border above the widening course should be shifted to the left, respectively, by the number of non-uniform widening stitches above, and below the widening course.

Most Preferred Embodiment

FIGS. 16 to 25 show the most preferred embodiment. The constitutive elements that are identical to those shown in FIGS. 2 to 13 are labeled with the same reference numerals, and explanation for the embodiments in FIGS. 2 to 13 is applicable to the most preferred embodiment of FIGS. 16 to 24 (hereinafter simply referred to as the "most preferred embodiment") unless specifically commented. The same signs of the positions or the areas such as P1 to P3, S1 to S3 are used as long as the types of the positions or the types of the areas are the same even if the actual positions or the areas are different.

The most preferred embodiment has the following features.

(1) In unslide correction, the portion of deleting the pattern due to the narrowing stitches, or the portion of adding the pattern due to the widening stitches are distributed in the pattern as uniformly as possible. Therefore, deletion of the pattern at one part, or interpolation of the pattern at one part is prevented. Hereinafter, in the gores, it is assumed that the process of widening is not carried out, but the process of narrowing is carried out. However, the widening stitches can be formed similarly.

(2) Further, by unslide correction, an area without any pattern is created at the end of the knitting width. The pattern on the outside of the area without any pattern is moved into the knitting width for supplement. If any pattern is present outside the supplemental area, the knitted fabric outside the supplemental area is warped around to the knitted fabric on the opposite side, e.g., the back body opposite to the front body. Thus, the design near the end of the knitted fabric becomes to be easily made, and the pattern at the end of the knitted width can also be made easily. Further, the design extending beyond the end toward the knitted fabric on the opposite side becomes easy.

(3) Layers are used in the design of the pattern. If a large pattern is designed by the design using gores, since the number of narrowing stitches is different between the upper portion and the lower portion of the pattern, the pattern may be deformed significantly. In contrast, if the pattern is divided into a plurality of layers by units of parts or the like for the design, deformation of the parts is reduced. Further, relative movement between the parts can be carried out easily. Even if a large pattern is designed, deformation of the pattern is reduced as a whole, and the design of the large pattern becomes easy.

(4) The design of a round pattern or a front-reverse (front-back) symmetrical pattern can be made easily. By the above-described supplement or warp-around operation, the process at the end (edge) of the knitted fabric becomes easy. Further, using layers, it is possible to adjust the relative position of the round pattern vertically, and reduce deformation by unslide correction of the round pattern on the upper side.

Figure 16:
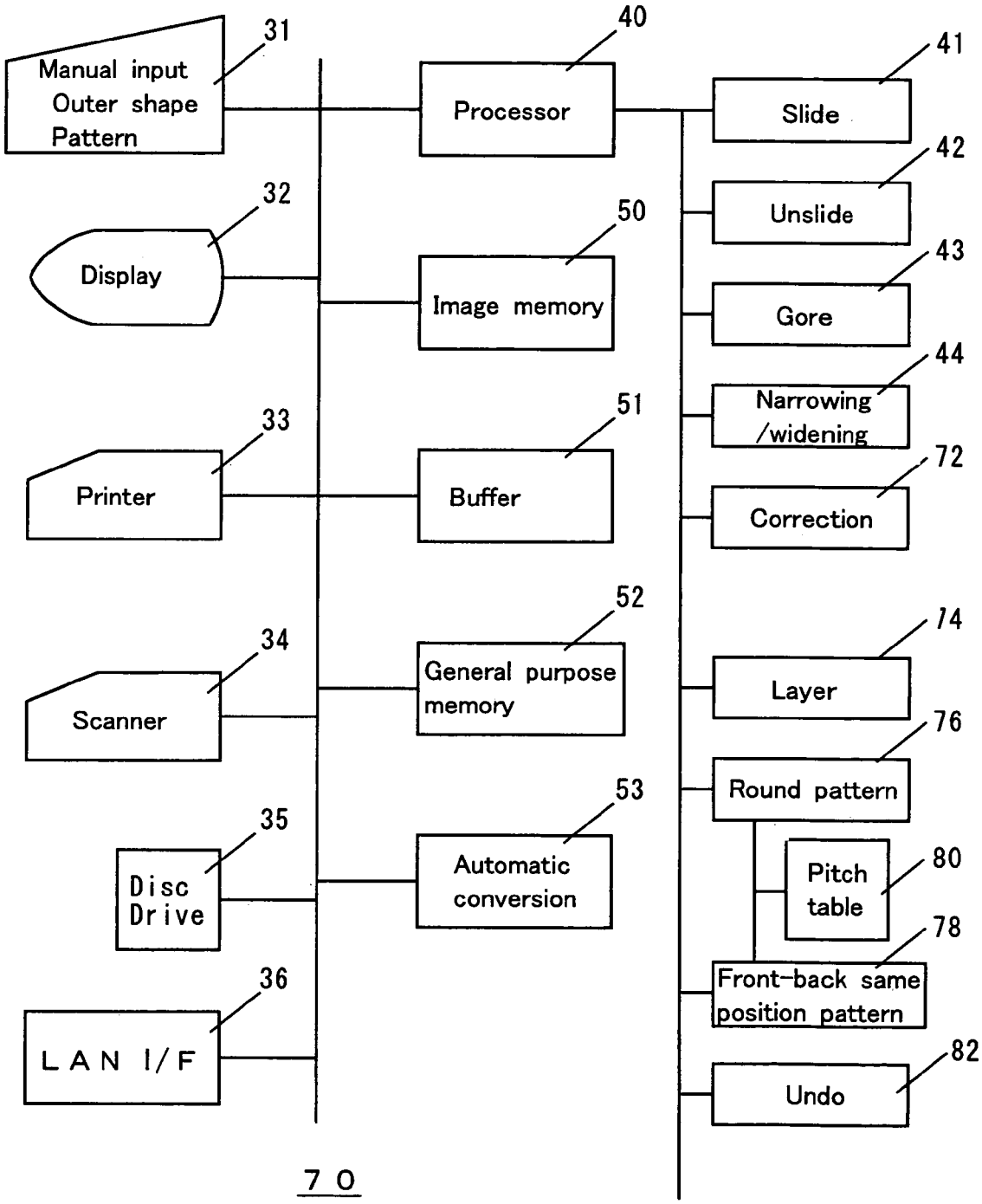
FIG. 16 is a block diagram showing a knit design apparatus according to the most preferred embodiment.

In FIG. 16, a reference numeral 70 denotes a novel knit design apparatus, and a reference numeral 72 denotes a correction unit. When the designed pattern is assigned to gores while the gores are combined together, part of the pattern is deleted in correspondence with narrowing stitches. Further, the processes such as supplemental operation for moving the pattern apparently outside the knitting width into the knitting width, or warp-around operation for warping the pattern of the area outside the area which is moved by supplemental operation of the knitted fabric on the opposite side are carried out. Further, means for storing rules regarding deletion of patterns such as a template is provided as desired to prevent deletion of important positions in design. In this case, positions around the important positions are deleted. The template represents a rule for determining which position is important, and which position is not important in design. A reference numeral 74 denotes a layer processing unit for generating layers and carrying out the process for the layers. Data of the layers is stored in an image memory 50 or the like as necessary. The layer itself is known. The same knitting stitch in the knitted fabric may have different items of data for respective layers. At the time of data confirmation, data of a plurality of layers are overlapped, and the priority between the layers is determined in accordance with a predetermined rule for confirming the design.

A reference numeral 76 denotes a round pattern generation unit for placing a pattern around the front knitted fabric and the back knitted fabric in units of layers. A front-back symmetrical pattern generation unit 78 copies the pattern of the knitted fabric on one side to the knitted fabric on the opposite side. A pitch table 80 stores the layout number, the layout pitch or the like of basic patterns as base units of the round pattern or the front-back symmetrical pattern. The distance between the basic patterns is calculated by subtracting the stitch number of the basic pattern in the left-right direction from the layout pitch. The layout pitch should be as uniform as possible. If the distance (gap) between the basic patterns is not uniform, for example, the portion where the gap is not uniform is assigned to a predetermined unnoticeable position, e.g., a central portion of the back body or a border portion between the front body and the back body, and a portion of the sleeve facing the body. For example, assignment of the position is carried out in accordance with a default rule. However, the user can change the position each time. In the round pattern or the front-back symmetrical pattern, a base point of the basic patterns is important in design. Simply by designation of the base point of the basic patterns, it is difficult to image the layout of the basic patterns, i.e., how a plurality of basic patterns are arranged, and what pitch is used. Therefore, the base point can be changed freely. An UNDO processing unit 82 is used for storing data about the progress of the process in the design apparatus 70 or the like, and returning the routine to the process designated by the user based on the stored data.

Figure 17:
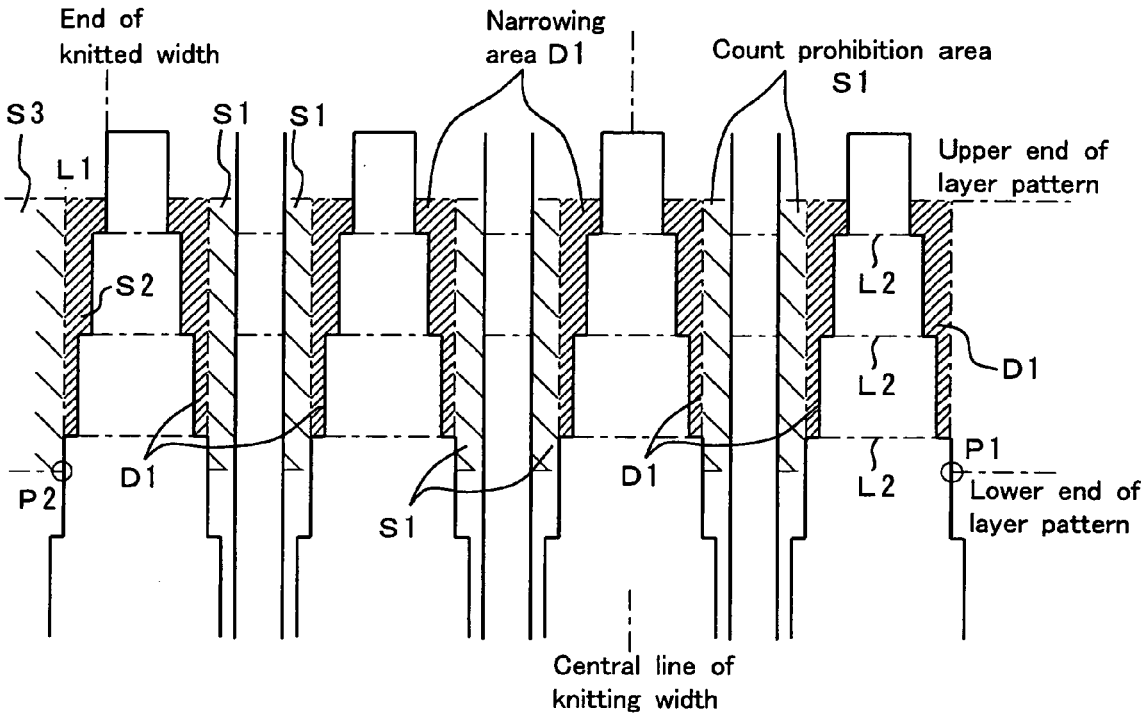
FIG. 17 is a view schematically showing unslide correction according to the most preferred embodiment.
Figure 18:
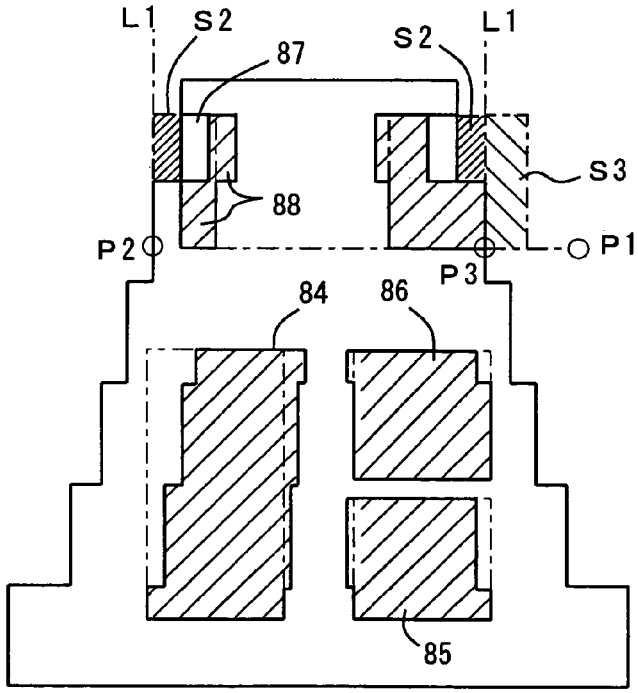
FIG. 18 is a view schematically showing unslide correction using a composite image created by sliding a plurality of gores.

FIG. 17 shows a design which is divided into individual gores by the unslide. The area from the center of the knitting width to one end of the knitted fabric (left side in FIG. 17) is shown mainly. The other side is shown partially, and the other end of the knitted fabric is not shown. Further, FIG. 18 shows another design in the composite state after the slide. The height position at the lower end of the pattern in the layers is P1, and at this height position, the area which already lost knitting stitches by the narrowing stitches is a count prohibition area S1. The area above the position P1 where knitting stitches generated by the narrowing stitches are not present is a narrowing area D1. At the height position P1, the opposite ends of the knitting width are end positions P2, P3. Borderlines L1 are lines extending upwardly from the end positions P2, P3. The inner area from the borderlines L1 toward the knitted fabric is a supplemental area S2, and the outer area opposite to the knitted fabric (outside) is a warp-around area S3.

In the correction of narrowing, for example, data of the pattern is assigned to the respective gores for the unslide. The position where vertically non-uniform narrowing stitches are present in the pattern are connected horizontally to detect the narrowing course L2. The number of non-uniform narrowing stitches above and below the narrowing course L2 is counted. In the courses above the narrowing course L2, the pattern is shifted to the center of the knitted fabric by the amount corresponding to the number of the counted non-uniform narrowing stitches. The process is carried out in the same manner as in the embodiments shown in FIGS. 2 to 13. At the time of shifting the pattern toward the center of the knitting width, the count prohibition area S1 is skipped, and the portion with gores and the narrowing area D1 are counted without skipping (the knitting stitches of the pattern are assigned), and shifted. Then, the pattern of portion assigned to the narrowing area D1 is deleted. As shown in FIG. 17, if there are three narrowing courses L2 arranged vertically in the pattern, at the uppermost portion of the pattern, portion corresponding to the three knitting stitches is deleted as one part. If the size of the pattern in the height direction in the layers is small including only one narrowing course L2, the size of the deleted pattern as one part corresponds to one stitch. The pattern is deleted in one vertical row stitch by stitch. Since the knitting stitches are not successively deleted in the left-right direction so often, it is possible to reduce deformation of the pattern due to the narrowing stitches.

For example, as shown in FIG. 18, it is assumed that there is a large pattern 84 (area denoted by a dotted line). If the entire pattern 84 is processed as one layer, the pattern is shrunk to the area denoted by a solid line (hatched area) in FIG. 18 by correction, and the upper part of the pattern is deformed significantly. In contrast, if the pattern is divided into, e.g., two layers 85, 86 by units of parts, the pattern (the hatched areas denoted by the solid lines in FIG. 18) is not deformed significantly. Further, if the pattern is divided into a plurality of layers by units of parts, the design is not affected significantly by correction of the narrowing stitches. In particular, even if the important part of the pattern is deleted by correction, by shifting the layer, it is possible to avoid deletion of the important part. Therefore, the design of the large pattern on the gores becomes easy.

As shown in the upper left part in FIG. 18, it is assumed that there is a vertical stripe shaped design 87 before correction. The design 87 is changed to a design 88 after correction. By the correction, an area without any pattern (area without hatching in the design 87) is generated at an end of the knitted fabric. By moving the supplemental area S2 to the area without any pattern, it is possible to design the pattern to the end of the knitting width. The supplemental area S2 is positioned near the knitted fabric in comparison with the line L1, and positioned outside the knitting width. In the upper right part in FIG. 18, an area outside the supplemental area S2 is designed, and the area becomes the warp-around area S3. The data of the warp-around area is applied to the knitted fabric on the opposite side as if the warp-around area S3 is folded back with respect to the line L1. If there is any pattern in the corresponding position in the knitted fabric on the opposite side, the priority of the pattern is determined by the user, or determined in accordance with the default rule (e.g., the data of the warp-around area S3 is deleted).

Figure 19:
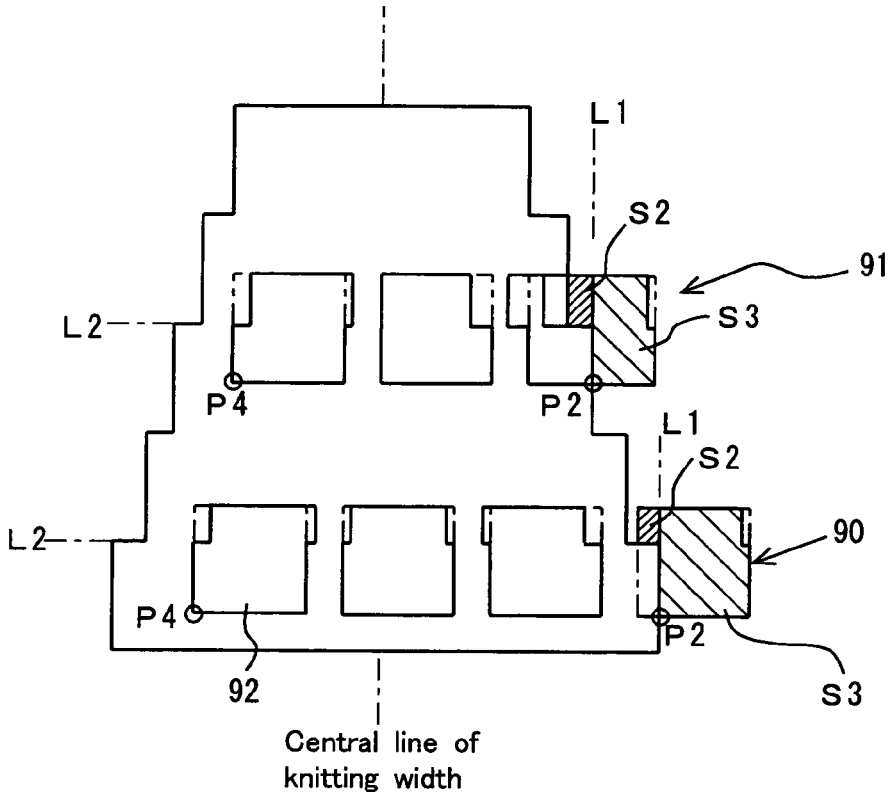
FIG. 19 is a view schematically showing a process for a round pattern according to the most preferred embodiment.

FIG. 19 schematically shows the design of two upper and lower round patterns 90, 91. It is assumed that the round patterns 90, 91 are designed in different layers. Points P4 in FIG. 19 are base points of the round patterns. In this case, for example, the round direction is the clockwise direction in FIG. 19. The number of stitches in the left-right direction in the basic pattern 92 is, e.g., n. Assuming that the basic pattern 92 has a substantially square shape as denoted by a dotted line, the design is deformed into a shape as denoted by a solid line by unslide correction. The base points P4 can be changed freely until the design is confirmed. Further, the relative position between the layers can be changed freely until the design is confirmed. In the case of the round pattern 90, assuming that the total stitch number of the front knitted fabric and the back knitted fabric at the lower end of the round pattern 90 is N, the following expression is obtained.

$$N \div n = m, \text{ the reminder is } r$$

In the expression, m is the maximum layout number of the basic patterns 92, r is the stitch number as the reminder, and r/m is the average interval between the basic patterns at the maximum layout number. If r/m is not an integral number, the gap between the basic patterns at the center of the back body or at the border between the front body and the back body is changed from that of the other position for adjustment. A list of values each obtained by adding the gap between the basic patterns to the base point P4 and n (start position of the next basic pattern) is used as a pitch table.

Figure 20:
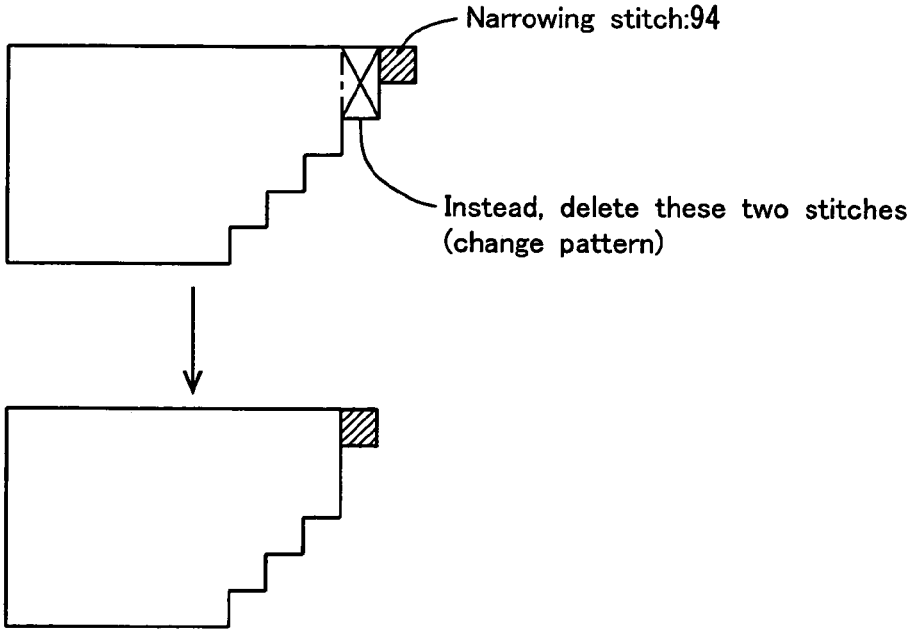
FIG. 20 is a view schematically showing a process of changing narrowing knitting stitches by unslide correction using a template according to the most preferred embodiment.

FIG. 20 is an example using a template. For example, the template stores a rule which determines that no vertex of the pattern is deleted. On the upper side in FIG. 20, if the position of the narrowing stitches is determined in the same manner as in the case of FIG. 7, a narrowing stitch 94 appears at a vertex of the pattern. The template stores a rule about the position of the narrowing stitch or the like. Design data or the like is used for checking which portion in the pattern corresponds to the determined position of the narrowing stitch. The position of the narrowing stitch 94 at the upper right corner on the upper side in FIG. 20 violates the rule. The template stores the process when the position of the narrowing stitch or the like violates the rule stored in the template. In this case, the process of narrowing is carried out in the adjacent wale in the pattern, and when the original narrowing stitches (narrowing stitch 94 herein) is positioned at the vertex, and comprises one stitch, the position of new narrowing stitches is determined such that the vertex comprising only one stitch is left in the pattern. For this purpose, for example, the correction position is changed to delete the two stitches adjacent to the vertex 94, and leave the important part in the design.

Figure 21:
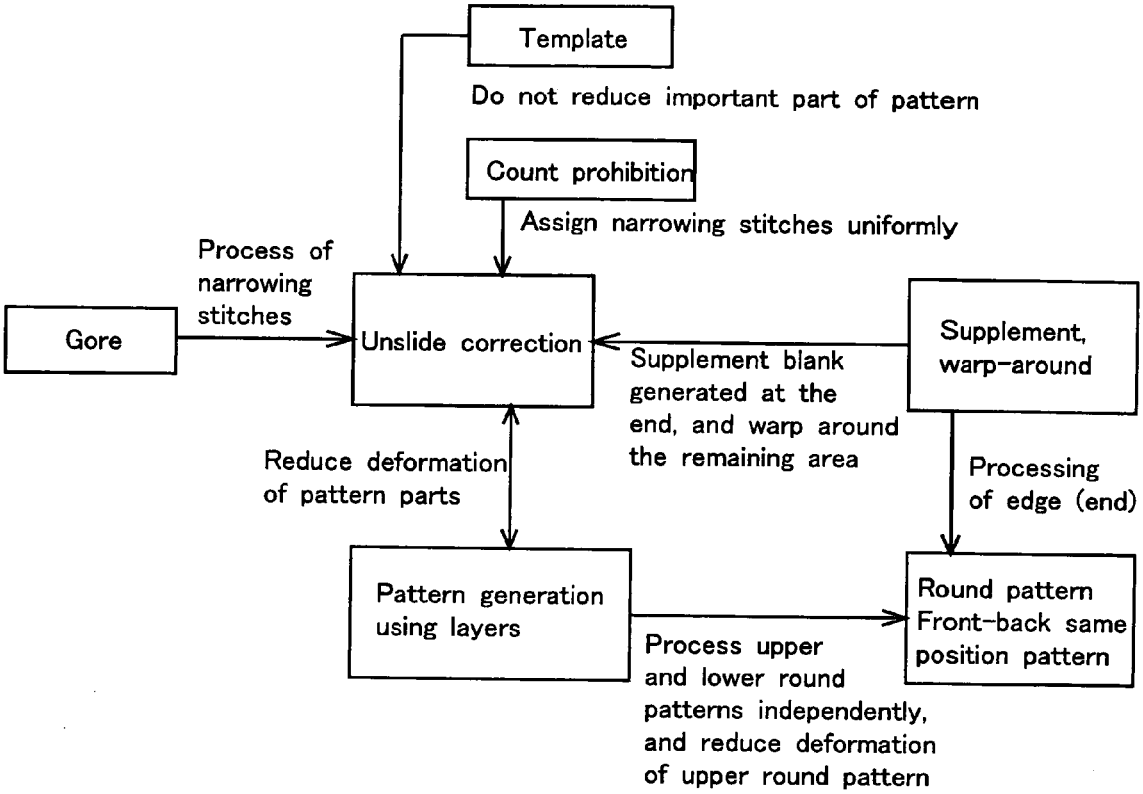
FIG. 21 is a diagram schematically showing the relationship between components according to the most preferred embodiment.

FIG. 21 shows the relationship between respective components in the most preferred embodiment. The problem of the design using gores is that since narrowing stitches are present, deformation occurs from the design of the slide image. In contrast, using the unslide correction in FIG. 17 or the like, the count prohibition area S1 is used such that the narrowing stitches are distributed uniformly in the pattern. Further, the template is used such that the important part of the pattern is not deleted.

If a pattern having a large size in the height direction is designed, the upper part of the pattern is deformed significantly by the unslide correction. Therefore, using the design of layers in units of parts, in consideration of the fact that deformation of the pattern is small in the layer having the small width in the height direction, deformation of the pattern is reduced. Further, by the relative movement of the layers, it is ensured that the image of the entire pattern is maintained, and no important part of the pattern is deleted.

By the unslide correction, an area without any pattern is generated at the end of the knitting width. Therefore, this area is supplemented by the supplemental area, and by assigning the warp-around area outside the supplemental area to the knitted fabric on the opposite side, the design extending beyond the end of the knitting width to the knitting fabric on the opposite side is made possible.

In the design of the round pattern or the front-back symmetrical pattern, for example, by processing the pattern including two rows, i.e., an upper row and a lower row using different upper and lower layers, deformation of the round pattern on the upper side is reduced, and the relative movement between the round patterns or the like is made possible. Further, by the process using the different upper and lower layers, it is possible perform the design of one is the round pattern, and the other is the front-back symmetrical pattern. By the supplemental operation and the warp-around operation, the process at the end of the knitting width becomes easy. The pattern moved by the unslide correction is supplemented by the supplemental area, and the pattern outside the supplemental area is warped around to the knitted fabric on the opposite side.

Figure 22:
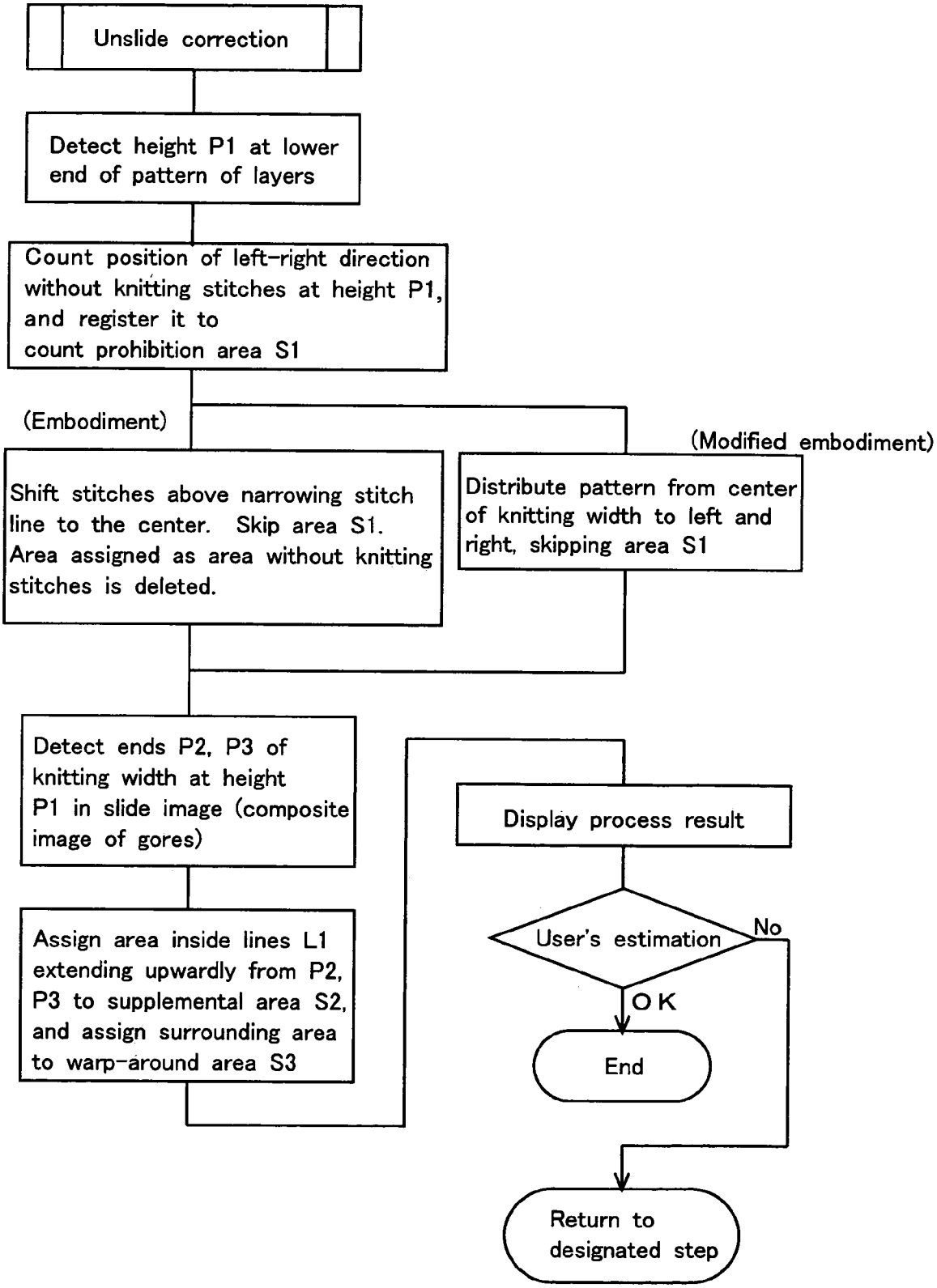
FIG. 22 is a flowchart showing an algorithm of unslide correction according to the most preferred embodiment.

FIG. 22 shows an algorithm of the unslide correction. The process is carried out for every layer. The height position P1 at the lower end in the pattern of layers is detected. At the height position P1, the area which has already lost knitting stitches (the lower area which has already been the designated as the target of the narrowing stitches) is determined as the count prohibition area S1, and the range of the count prohibition area S1 in the left-right direction is registered. Further, the area above the height position P1 which is going to lose knitting stitches by the narrowing course is registered as the narrowing area D1. Description of FIGS. 22 to 24 will be given using the reference numerals in FIGS. 17 to 19.

In one embodiment, the pattern is moved at the time of the unslide of the gores. The pattern is assigned to the gores after a temporal unslide. Then, the pattern above the narrowing course L2 is moved toward the center of the knitted width by the amount corresponding to the asymmetrical narrowing stitches above and below the narrowing course L2 from the center of the knitted width. At this time, the moved stitches are not counted in the count prohibition area S1. The data of the pattern where the destination of the movement is included in the narrowing area D1 is deleted.

In a modified embodiment, the pattern is not moved at the time of unslide of the gores. The data of the pattern is assigned to the unslide image, i.e., the image of the outer shape of the knitted fabric in units of gores with the count prohibition area S1 or the narrowing area D1. For example, there are two types of data of the outer shape of the knitted fabric, i.e., the unslide image and the slide image. These items of data are the most basic data. The assignment of the pattern data is carried out from the center to the left and the right of the knitting width. The data of layers of the pattern (pattern data) is not assigned to the count prohibition area, and the pattern data assigned to the narrowing area D1 is deleted. The process in the embodiment and the process in the modified embodiment are the same process, but the order of carrying out the process is different.

Additionally, the ends P2, P3 of the knitting width at the height position P1 of the slide image are determined. Lines L1 extend from the ends P2, P3 upwardly. The area between the ends of the knitting width and the lines L1 is determined as the supplemental area S2. If any pattern is present outside the lines L1, the area is assigned to, and included in the warp-round area S3.

After all the layers are processed, or after one layer is processed, the process result is displayed to the user, e.g., using both of the unslide image and the slide image. If the user approves the process result, the routine proceeds to the next process. If the process result needs to be changed, the routine proceeds back to the step designated by the user. Thus, it is possible to change the relative movement between the layers, and the knitting stitches to be deleted, e.g., manually.

Figure 23:
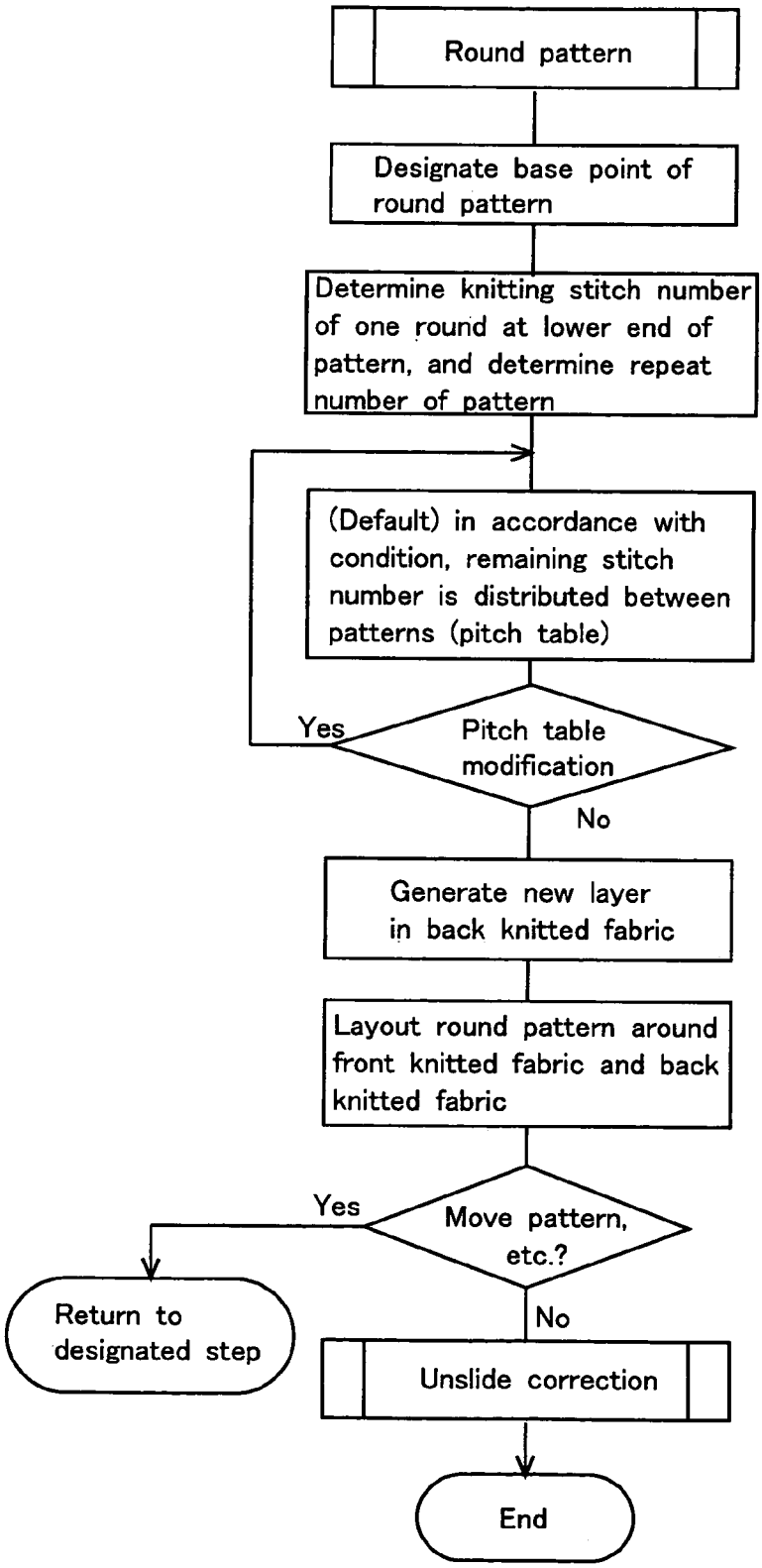
FIG. 23 is a flowchart showing an algorithm for generating a round pattern according to the most preferred embodiment.

FIG. 23 shows the process of a round pattern. A base point P4 of the round pattern is designated. The number of stitches for one round at the lower end position of the pattern (the total stitch number of the front knitted fabric and the back knitted fabric) is divided by the stitch number of the basic pattern. The number and the layout pitch of basic patterns, and the position of the base point P4 are stored in the pitch table. The layout pitch may change depending on the basic pattern number counted from the base point P4. The portion where the pitch is not uniform is assigned to the center of the back body or the end of the knitted width (border between the front body and the back body) by default, and the position for assigning the portion where the pitch is not uniform can be changed by the user.

In the front knitted fabric such as the front body, the basic pattern 92 is designed or retrieved, the base point P4 is designated, and the pitch table is generated. Then, the layers used in the back knitted fabric for the round pattern is generated. The basic pattern is placed in accordance with the pitch table, around the front knitted fabric and the back knitted fabric. If any modification such as the change of the base point or the change of the layout number is inputted by the user, the routine proceeds back to the corresponding step for modification. Initially, the maximum number of the layout number (the number of basic patterns) is stored. The user can modify the layout number. Likewise, the layout pitch or the like may be modified by the user. If there is no modification, the unslide correction is carried out, and the design of the round pattern for one layer is finished.

Figure 24:
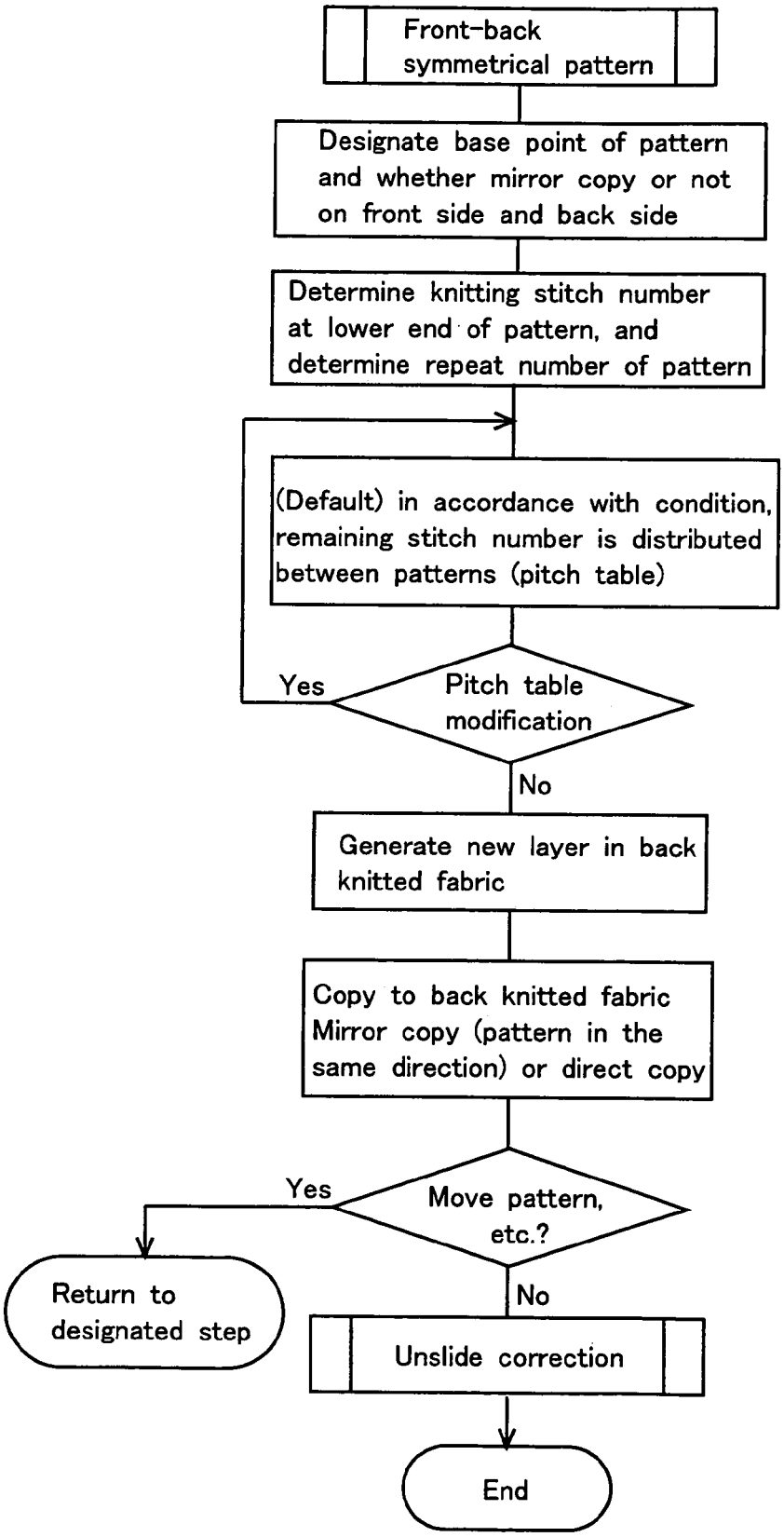
FIG. 24 is a flowchart showing an algorithm for generating a front-back symmetrical pattern according to the most preferred embodiment.

FIG. 24 shows a design algorithm of a front-back symmetrical pattern. Since the algorithm of FIG. 24 is similar to that of FIG. 23, only differences will be described, and the other points are the same. The types of the patterns include a mirror copy and a direct copy. In the case of the mirror copy, for example, the left pattern of the front knitted fabric is copied to the right side of the back knitted fabric symmetrically with respect to the central line of the left-right direction of the knitted width. In the case of the direct copy, for example, the left pattern of the front knitted fabric is copied to the left side of the back knitted fabric, and no symmetrical movement with respect to the central line of the left-right direction of the knitting width is performed. Further, the process is performed in units of layers, i.e., the process is performed for each of layers.

At the time of generating the pitch table, for example, the layout of the basic patterns is performed in a range where the basic patterns do not extend to the knitted fabric on the opposite side (e.g., within the range to the supplemental area S2). Basically, the design extending over the front knitted fabric and the back knitted fabric is not performed. However, the design extending over the front knitted fabric and the back knitted fabric may be acceptable. In the same manner as in the case of the round pattern, a new layer is generated on the back knitted fabric or the like. The data of the pattern of the front knitted fabric is copied by the mirror copy or the direct copy. The presence of modification such as movement of the base position of the pattern is confirmed. After the design is confirmed as OK, the unslide correction is performed.

Figure 25:
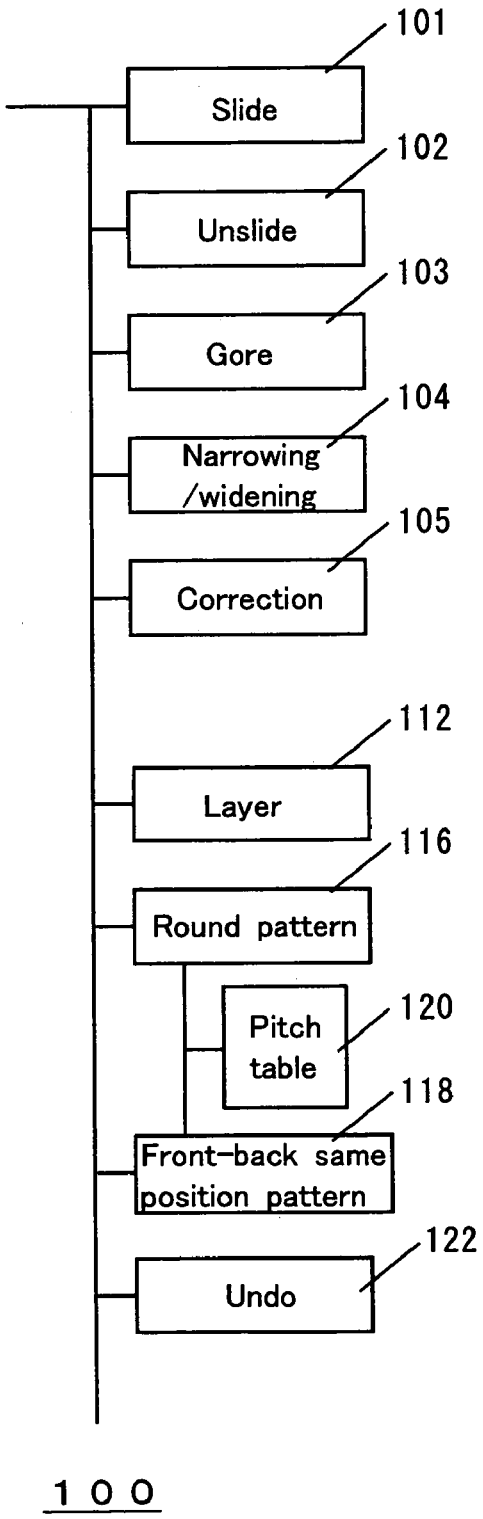
FIG. 25 is a block diagram showing a knit design program for the most preferred embodiment.

FIG. 25 shows a knit design program according to the most preferred embodiment. Commands are processed by the processor 40 or the like. A slide command 101 is a command for forming a composite image by combining a plurality of gores or a plurality of blocks. An unslide command 102 is a command for dividing the composite image 2 into a plurality of gores or a plurality of blocks. A gore command 103 is a command used at the time of designing the knitted fabric designed using gores of a flared skirt or a, sweater in a parachute pattern for dividing the outer shape of the knitted fabric into gores or blocks.

A narrowing/widening command 104 is used for inserting a narrowing course or a widening course for every predetermined number of courses or at a position inputted manually or the like. A correction command 105 is used for shifting portion the pattern extending over a plurality of gores, and spread to the above, and below the narrowing stitch course or the widening stitch course toward the center of the knitted fabric or toward both of outer sides of the knitted fabric.

A correction command 112 is used at the time of assigning a pattern which is designed while the gores are combined together, to the gores, for deleting part of the pattern in correspondence with narrowing stitches. Further, the correction command 112 is used in the supplemental operation for moving the pattern which is apparently outside the knitting width into the knitting width, or the warp-around operation for warping the pattern of the area outside the area which can be moved in the supplemental operation, around to the knitted fabric on the opposite side. Further, the correction command 112 is used for storing the above-described template or the like such that the important position in design cannot be deleted. A layer command 114 is used for generating layers, and carrying out the process for this purpose.

A round pattern generation command 116 is used for placing the pattern around the front knitted fabric and the back knitted fabric in units of layers. A front-back symmetrical pattern generation command 118 is used for copying a pattern of the knitted fabric on one side to the knitted fabric on the other side with mirror inversion or without mirror inversion. A pitch table storage command 120 is used for storing the pitch table. An UNDO command 122 is used for storing the record of the process in the design apparatus, and restoring the process to the condition designated by the user based on the stored record.

The invention claimed is:

1. A method of designing a knitted fabric by dividing a design of the knitted fabric into a plurality of parts, the method comprising the steps of:

designing a pattern spread over a plurality of parts on a composite image of the plurality of parts such that the pattern is spread above and below a narrowing course or a widening course, and forming narrowing stitches and widening stitches at borders between the parts in the narrowing course and the widening course, respectively;

then, determining the number of non-uniform narrowing stitches or widening stitches above and below the narrowing course or the widening course from the central side in the left-right direction of the knitted fabric to the outer side in the left-right direction of the knitted fabric;

shifting a portion of the pattern on the upper side of the narrowing course, and extending over the plurality of parts, toward the central side in the left-right direction of the knitted fabric relative to a portion of the lower side of the narrowing course by the amount corresponding to the non-uniform stitch number of the narrowing stitches, or shifting a portion of the pattern on the upper side of the widening course, and extending over the plurality of parts, toward the outer side in the left-right direction of the knitted fabric relative to the portion of the lower side of the widening course by the amount corresponding to the non-uniform stitch number of the widening stitches;

wherein the central side and the outer side of a portion along the left-right direction of the knitted fabric, on the upper side of the narrowing course and the widening course, are shifted respectively, toward the left-right direction of the knitted fabric non-uniformly, in correspondence with the difference in the non-uniform narrowing or widening stitch number between the central side and the outer side; and assigning the portion of the shifted pattern to the plurality of parts.

2. The knit design method of claim 1, wherein the plurality of parts comprise a plurality of gores, or a body and a sleeve.

3. The knit design method of claim 1, wherein the non-uniform stitch number of the narrowing stitches or the widening stitches is determined for each of left and right borders of the pattern, and respective left and right borders of the pattern on the upper side of the narrowing course or the widening course are shifted relative to borders on the lower side by the amount corresponding to the determined non-uniform stitch number.

4. The knit design method of claim 3, wherein after the left and right borders of the pattern on the upper side is shifted relative to the borders on the lower side by the amount corresponding to the determined non-uniform stitch number, the pattern is assigned to the plurality of parts.

5. The knit design method of claim 1, wherein after the pattern is assigned to the plurality of parts imaginarily, portions of the respective parts of the pattern are shifted in the left-right direction by the amount corresponding to non-uniform narrowing stitches or widening stitches, and by the shift, data of the pattern assigned to imaginary wale without knitting stitches is deleted, or by the shift, if any wale which does not have assigned data of the pattern is generated, data of the pattern of the surrounding data is assigned.

6. The knit design method of claim 1, wherein an area which has already lost knitting stitches by the narrowing stitches at the height position of the lower end of the pattern is registered as a count prohibition area, an area which is going to lose knitting stitches by the narrowing stitches at the position higher than the lower end of the pattern is registered as a narrowing area, data of the pattern is assigned to the parts and the narrowing area such that the count prohibition area is skipped, and the data of the pattern assigned to the narrowing area is deleted.

7. The knit design method of claim 1, wherein the pattern of the entire knitted fabric is divided into a plurality layers, the layers are processed one by one, and relative movement between the layers is made possible.

8. The knit design method of claim 1, wherein data of the pattern between a line extending from the height position of the lower end of the of the pattern and the end of the knitted fabric on a composite image of the plurality of parts is shifted into the knitting width as supplemental data, and by the shift, an area without any pattern near the end of the knitted fabric is supplemented.

9. The knit design method of claim 8, wherein data outside the supplement area is warped around to the knitted fabric on the opposite side on the composite image of the plurality of images.

10. The knit design method of claim 1, wherein the knitted fabric is a cylindrical knitted fabric, and based on a base position of the basic pattern as a unit of a round pattern, the stitch number for one round of the cylindrical knitted fabric near the base point, and the stitch number of the basic pattern, the layout of the basic pattern is determined.

11. A knit design apparatus comprising image input means, means for dividing a design image of a knitted fabric inputted by the image input means into a plurality of parts, means for converting the design image between a composite image formed by combining the plurality of parts and the plurality of parts, and means for converting the obtained image data into knitting data used in a knitting machine, the knit design apparatus further comprising:

means for detecting that a pattern of the kited fabric inputted on the composite image is spread over the plurality of parts, and spread above and below a narrowing course or a widening course, narrowing stitches and widening stitches being formed at borders between the parts in the narrowing course and the widening course, respectively;

means for determining the number of non-uniform narrowing stitches or widening stitches above and below the narrowing course or the widening course from the central side in the left-right direction of the knitted fabric to the outer side in the left-right direction of the knitted fabric;

means for shifting a portion of the pattern on the upper side of the narrowing course and extending over the plurality of parts, toward the central side in the left-right direction of the knitted fabric relative to a portion of the lower side of the narrowing course by the amount corresponding to the non-uniform stitch number of the narrowing stitches, or shifting a portion of the pattern on the upper side of the widening course and extending over the plurality of parts, toward the outer side in the left-right direction of the knitted fabric relative to the portion of the lower side of the widening course by the amount corresponding to the non-uniform stitch number of the widening stitches;

wherein the means for shifting shifts the central side and the outer side of a portion along the left-right direction of the knitted fabric, on the upper side of the narrowing course and the widening course, respectively, toward the left-right direction of the knitted fabric non-uniformly, in correspondence with the difference in the non-uniform narrowing or widening stitch number between the central side and the outer side; and means for assigning the portion of the shifted pattern to the plurality of parts.

12. The knit design apparatus of claim 11, wherein the plurality of parts comprise a plurality of gores, or a body and a sleeve.

13. The knit design apparatus of claim 11, further comprising: means for assigning the pattern to the plurality of parts imaginarily; and means for shifting the portion of the respective parts of the pattern in the left-right direction by the amount corresponding to non-uniform narrowing stitches or widening stitches, and by the shift, deleting data of the pattern assigned to imaginary wale without knitting stitches, or by the shift, if any wale which does not have assigned data of the pattern is generated, assigning data of the pattern of the surrounding data.

14. A computer-readable medium storing computer-executable instructions for performing knit design, by performing operations comprising:

dividing a design image of a knitted fabric into a plurality of parts, a command for converting the design image between a composite image formed by combining the plurality of parts and the plurality of parts, and converting the obtained image data into knitting data;

detecting that a pattern of the knitted fabric inputted on the composite image is spread over the plurality of parts, and spread above and below a narrowing course or a widening course, narrowing stitches and widening stitches being formed at borders between the parts in the narrowing course and the widening course, respectively;

determining the number of non-uniform narrowing stitches or widening stitches above and below the narrowing course or the widening course from the central side in the left-right direction of the knitted fabric to the outer side in the left-right direction of the knitted fabric;

shifting a portion of the pattern on the upper side of the narrowing course and extending over the plurality of parts, toward the central side in the left-right direction of the knitted fabric relative to a portion of the lower side of the narrowing course by the amount corresponding to the non-uniform stitch number of the narrowing stitches, or shifting a portion of the pattern on the upper side of the widening course and extending over the plurality of parts, toward the outer side in the left-right direction of the knitted fabric relative to the portion of the lower side of the widening course by the amount corresponding to the non-uniform stitch number of the widening stitches; and assigning the portion of the shifted pattern to the plurality of part;

wherein the operation for shifting shifts the central side and the outer side of a portion along the left-right direction of the knitted fabric, on the upper side of the narrowing course and the widening course, respectively, toward the left-right direction of the knitted fabric non-uniformly, in correspondence with the difference in the non-uniform narrowing or widening stitch number between the central side and the outer side.

* * * * *